US005900857A

United States Patent [19]

Kuwata et al.

[11] Patent Number: 5,900,857

[45] Date of Patent: May 4, 1999

[54] METHOD OF DRIVING A LIQUID CRYSTAL DISPLAY DEVICE AND A DRIVING CIRCUIT FOR THE LIQUID CRYSTAL DISPLAY DEVICE

[75] Inventors: Takeshi Kuwata; Kazuyoshi Kawaguchi; Yoshinori Hirai, all of Yokohama, Japan

[73] Assignee: Asahi Glass Company Ltd., Tokyo, Japan

[21] Appl. No.: 08/648,960

[22] Filed: May 17, 1996

[30] Foreign Application Priority Data

May 17, 1995 [JP] Japan ..... 7-118654
Jun. 12, 1995 [JP] Japan ..... 7-145017

[51] Int. Cl.[6] ..... G09G 3/36

[52] U.S. Cl. ..... 345/100; 345/98; 345/517

[58] Field of Search ..... 345/100, 103, 345/200, 203, 98, 508, 516, 517

[56] References Cited

U.S. PATENT DOCUMENTS 4,630,122 12/1986 Morokawa .
4,740,786 4/1988 Smith .
4,745,485 5/1988 Iwasaki .
4,816,816 3/1989 Usui .
4,908,710 3/1990 Wakai et al. .
5,262,881 11/1993 Kuwata et al. ..... 345/93
5,475,397 12/1995 Saidi ..... 345/100
5,481,651 1/1996 Herold ..... 345/100
5,548,302 8/1996 Kuwata et al. ..... 345/95
5,617,113 4/1997 Prince ..... 345/103
5,646,652 7/1997 Saidi ..... 345/100
5,684,502 11/1997 Fukui et al. ..... 345/100
5,689,280 11/1997 Asari et al. ..... 345/100
5,754,157 5/1998 Kuwata et al. ..... 345/507
5,831,586 11/1998 Hirai et al. ..... 345/100

*Primary Examiner*—Amare Mengistu
*Attorney, Agent, or Firm*—Oblon, Spivak, McClelland, Maier & Neustadt, P.C.

[57] ABSTRACT

A method of driving a liquid crystal display device by selecting simultaneously a plurality of lines in a liquid crystal display element characterized in that display data are temporality stored in memories; the data are read out plural times from the memories, and arithmetic operation are performed to the read-out data to produce signals to be applied to data electrodes, wherein the picture area is divided into a plurality of picture area blocks each including scanning lines the number of which are a multiple of a natural number of simultaneously selected scanning lines; the memories are divided into a plurality of memory blocks each having capacity capable of reading and writing data displayed on the picture area blocks; fames for writing are made in synchronism with frames for reading the data, and a memory block undergoes a predetermined number of times of reading, and then new display data are written into said memory block.

20 Claims, 19 Drawing Sheets

FIGURE 14 (a)
(A) Example of 4 × 4 Adamard's matrix
| | | | | |
|---|---|---|---|---|
| L = 1 | 1 | 1 | 1 | 1 |
| L = 1 | 1 | −1 | 1 | −1 |
| L = 1 | 1 | 1 | −1 | −1 |
| L = 1 | 1 | −1 | −1 | 1 |
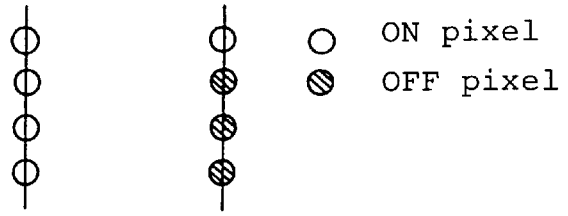
FIGURE 14 (b)
Column elctrode i
(d) (−1 −1 −1 −1)
(v) (−4 0 0 0)
Column electrode j
(d) (−1 1 1 1)
(v) (2 −2 −2 −2)
FIGURE 14 (c)
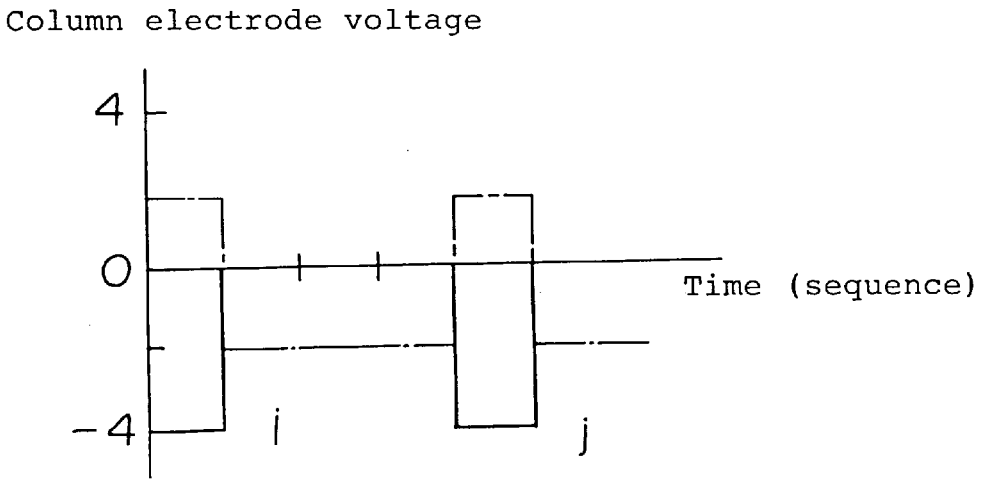

METHOD OF DRIVING A LIQUID CRYSTAL DISPLAY DEVICE AND A DRIVING CIRCUIT FOR THE LIQUID CRYSTAL DISPLAY DEVICE

BACKGROUND OF THE INVENTION

1. Field of the Invention

The present invention relates to a driving circuit for a liquid crystal display device suitable for driving a fast response type liquid crystal display element. In particular, the present invention relates to a driving circuit suitable for a liquid crystal display device driven by a multiple line selection method.

2. Discussion of the Background

A STN liquid crystal element is a liquid crystal display element responsive depending on the root mean squared (RMS) value of an applied voltage. In the liquid crystal display element, when a STN liquid crystal display element of a fast responsive type is used, a so-called frame response wherein an optical change between an ON state and an OFF state becomes small to reduce the contrast ratios takes place. Accordingly, when a line successive selection method is used to drive the liquid display element, there is a limit to drive the STN liquid crystal element at a high speed.

Accordingly, in order to the drive the STN liquid crystal element at a higher speed, a multiple line selection method (MLS method) has been proposed. The multiple line selection method is a method of driving a plurality of scanning electrodes (row electrodes) simultaneously. In the multiple line selection method, a predetermined pulse train is applied to each of the simultaneously driven row electrodes in order to control independently a column display pattern to be applied to data electrodes (column electrodes).

A voltage pulse group (a selection pulse group) applied to each of the row electrodes can be expressed by a matrix of L-row·K-column. Hereinafter, the matrix is referred to as a selection matrix (A) wherein L represents a number simultaneously selected. The voltage pulse group can be expressed by a group of vectors which are mutually orthogonal. Accordingly, a matrix including these vectors as elements is an orthogonal matrix. Each of the column vectors in the matrix is mutually orthogonal. In the orthogonal matrix, each row corresponds to each line in the liquid crystal display element. For instance, the first line in an L number of selection lines corresponds to the elements of the first row in the selection matrix (A). Namely, the first row electrode is applied with selection pulses of the elements of first row, the elements of second row . . . in this order.

FIG. 14 is a diagram showing a sequence of voltage waveforms applied to column electrodes. In FIG. 14, an Hadamard's matrix of 4 row·4 column is used for the selection matrix (A). In the selection matrix (A) in FIG. 14, "1" indicates a positive selection pulse and "−1" indicates a negative selection pulse.

Supposing that display data on column electrodes i and j are as shown in FIG. 14*a,* a column display pattern can be expressed as a vector d as shown in FIG. 14*b.* In FIG. 14*b,* a numerical value "−1" corresponds to an ON display and "1" corresponds to an OFF display pattern. Voltage patterns successively applied to the column electrodes i, j have vectors v as shown in FIG. 14*b.* These vectors correspond to sums as a result of an exclusive OR operation for each bit in a column display pattern (a picture display pattern) and a row selection pattern corresponding thereto. The waveform of the vectors is shown in FIG. 14*c.* In FIG. 14*c,* the ordinate represents voltage applied to the column electrodes and the abscissa represents time wherein each unit is arbitrary.

When a liquid crystal display element is driven by a multiple line selection methods it is desirable that factors for voltage application be dispersed in a display cycle in order to suppress a frame response of the liquid crystal display element. Specifically, for instance, such a sequence that the first factor of the vectors is applied to the simultaneously selected first row electrode group (hereinbelow, referred to as subgroup), and then, the first factor of the vectors is applied to simultaneously selected second subgroup, is carried out.

Generally, the pulse width of a waveform for driving the liquid crystal display element is determined to be about 10 μsec — several 10 μsec from the stand point of using a large number of scanning lines and easiness of seeing. Accordingly, a frequency of one display cycle at the liquid crystal display element side is generally about 70–200 Hz. On the other hands a frequency of inputted picture signal is about 60 Hz. Accordingly, it is necessary to adjust a speed of input signal and the speed of signal outputted to the liquid crystal display element side in a liquid crystal driving device.

Such adjustment is generally realized by memories. Namely, the adjustment is realized by writing temporarily input picture image data in the memories, and by reading the written data in an asynchronous manner with respect to the writing operations. For instance, when a frequency of input picture signal is 60 Hz, and a frequency of one display cycle at the liquid crystal element side is 120 Hz, it is necessary that when the data corresponding to a picture are written in the memories, reading of the data from the memories should be done twice. When a multiple line selection method is used, it is necessary to treat K times for a picture image. Accordingly, when data for one picture image are written in the memories, 2K times of reading of the data from the memories has to be carried out.

In the multiple line selection method, the same display data are dispersed in a display frame period and the display data are used plural times. Accordingly, it is necessary to hold the same data for predetermined data periods. Thus, memories are essential. As a quantity of information to be displayed becomes large, a larger number of memories should be used. For a high density display such as VGA, SVGA, XGA and so on, an improved memory control technique is needed.

A conventional memory control technique will be described wherein a frame rate control (FRC) method is employed as a gradation method, and amplitude modulation or pulse width modulation is not used. In the line successive selection method (APT or IAPT) as a conventional driving method for STN, display data for each pixel are used only once in a display frame. Accordingly, when an input frame is in synchronism with an output frame, it is sufficient to display with memories having the capacity as shown in the following Table, and data can be controlled by a simple memory management.

TABLE 1

| | Input frame = Output frame | Input frame = 2 output frames |
|---|---|---|
| Single scan driving | Non | 2 picture areas |
| Dual scan driving | ½ picture areas | ½ picture areas |

In this Table, "single scan driving" means a driving method wherein a picture surface is scanned by one continual scanning operation, and "dual scan driving" is a driving method wherein an upper portion and a lower portion of a picture area are scanned by an independent scanning operation respectively. "Input frame=2 output frames" means that one frame for input corresponds to two frames for output wherein output data from the output frame comprises different elements between the two frames due to a FRC graduation treatment In this text, it is also referred to as a double frequency driving.

Generally speaking, in the single scan driving in the line successive driving method, when the length of frames for writing data in memories is formed to be n times (n: a natural number) as large as the length of frames for reading, provision of memories for an n number of picture areas is sufficient for driving. This is because as soon as the data are once read from the memories, the next data can be written in the memories. In particular, when the output frames are in agreement with the input frames, a speed of reading data from the memories agrees with a speed of writing data in the memories. This is a special case which can further save memories corresponding to a picture area. Namely, when the output frames agree with the input frames, memories are unnecessary. Even in this case, however, memories for one picture area are necessary in an asynchronous driving wherein the input frames do not synchronize with the output frames.

In a case of the dual scan driving, a phase of scanning is shifted by half periods between the upper and lower picture areas, and accordingly, memories corresponding to 1/2 picture areas can be saved in comparison with a case of the single picture area driving. In particular, when one frame for input corresponds to two frames for output, the speed of reading data from the memories agrees with the speed of writing. This is a special case which can further same memories for one picture ares, and memories for 1/2 picture areas are sufficient for driving.

On the other hand, since data on respective pixels are used several times (4 times in L=4 and 8 times in L=7) in a frame period in the multiple line selection method. Accordingly, it is impossible to write next data in the memories at the time when the data have just read once from the memories. Accordingly, it is necessary to hold data in order to strictly control the reading and the writing of the data in the memories, and the number of memories is increased in comparison with the conventional driving method.

The quantity of memories required for driving in the multiple line selection method is generally as follows.

In a case of the single scan driving wherein the length of frames for writing data in memories is formed to be n times (n: a natural number) as the length of the frames for reading, driving of the liquid crystal element is possible when n picture areas are prepared for input and output respectively. Namely, 2n picture areas are required.

In a case of the dual scan driving wherein writing is successively conducted on the memories from which data are read out, when n is an odd number, memories corresponding to (n−1)/2 picture areas can be saved, and when n is an even number, memories corresponding to n/2 picture areas can be saved. Supposing that the phase is shifted by 180° between the upper and lower picture areas, and when n is an odd number, memories corresponding to (n+1)/4 picture areas can be saved. On the other hand, when n is an even number, memories corresponding to n/4 picture areas can be saved. In short, the quantity of memories required in the conventional technique is that corresponding to (5n+1)/4 picture areas when n is an odd number, and that corresponding to 5n/4 picture areas when n is an even number.

Accordingly, when the input frames are in synchronism with the output frames, capacities of memories as shown in the following table are required. Namely, a more number of memories is required in comparison with line successive selection method, and a complicated memory control and an increased cost for the circuit are unavoidable. When input frames are not in synchronism with the output frames, a large number of memories is required.

TABLE 2

| | Input frame = Output frame | Input frame = 2 output frames |
|---|---|---|
| Single scan driving | 2 picture areas | 4 picture areas |
| Dual scan driving | 1.5 picture areas | 2.5 picture areas |

At present, double frequency driving of the dual picture area driving method is used mainly for information devices such as personal computers. In this case, use of memories corresponding to 0.5 picture areas is sufficient for driving when the conventional successive selection method is used. On the other hand, memories corresponding to 2.5 picture areas are necessary for the multiple line selection method. Requirement of 5 times of memory capacity is a big problem in promoting use of the multiple line selection method. Specifically, in a VGA color (640×480×RGB), an SVGA color (800×600×RGB) and an XGA color (1024×768×RGB), memory capacities are required as shown in the following table. It is understood that the multiple line selection method requires a large memory capacity in comparison with the conventional method.

TABLE 3

| | VGA | SVGA | XGA |
|---|---|---|---|
| Line successive selection method | 0.5 Mbits | 0.7 Mbits | 1.2 Mbits |
| Multiple line selection method | 2.3 Mbits | 3.6 Mbits | 5.9 Mbits |

FIG. 15 is a block diagram showing a construction of driving circuit 200 for a liquid crystal display device proposed by the inventor in this application in Japanese Unexamined Patent Publication No. 348237/1994. The structure is employed in order to reduce memory capacity as possible in several structures disclosed in Japanese Unexamined Patent Publication No. 348237/1994. The driving circuit operates as described below under the control by a control circuit 150.

As shown in FIG. 15, respective picture image data of R, G and B having graduation information are inputted to a frame modulation circuit 110. The frame modulation circuit 110 converts the inputted picture image data into ON/OFF 1 bit data for each display cycle to output the converted data to a serial-parallel converter 120 which comprises shift resistors and so on. The serial-parallel convertor 120 converts serial data from the frame modulation circuit 110 into parallel data having a predetermined bit width. A memory 130 consisting of VRAM stores picture image data corresponding to one frame. The memory 130 stores data in such a manner that the data of RGB are collected together in a set and each RGB data on an L number of simultaneously selected row electrodes which correspond to a column electrode are set to an L number of continuous addresses. Accordingly, when reading of data is conducted successively from the memory 130 according to an access mode, data corresponding to voltages applied to column drivers 80 are outputted. The data in the memory 130 are outputted to a format converter 190 in synchronism a timing of data input.

The format converter 190 is a circuit for arranging a data format, and conducts a vertical/lateral conversion treatment and so on. The output of the format convertor 190 is supplied to a column voltage signal generator 180. The column voltage signal generator 180 produces voltage values to be applied to column electrodes based on a row selection pattern from a row selection pattern generator 7 and the output of the format convertor 190. The produced output of voltage values is supplied to the column drivers 80. The row selection pattern from the row selection pattern generator 7 is supplied also to row drivers 90. The column drivers 80 and the row drivers 90 drive column electrodes and row electrodes of a liquid crystal display pattern 40 based on the inputted signals. A driver control circuit 60 controls a driving timing to the column drivers 80 and the row drivers 90.

The driving circuit of the conventional liquid crystal display device as shown in FIG. 15 performs frame modulation before the data are stored in the memory 130, and a relatively simple circuit structure can be obtained. However, the memory 130 is required to have a read memory and a write memory which correspond two picture areas. Further, the VRAM used as the memory 130 is relatively expensive whereby the driving circuit can not be constituted economically. Further, the driving circuit have a problem that power consumption rate and radiation noise are relatively large because memory access is necessary at a high speed.

SUMMARY OF THE INVENTION

It is an object of the present invention to provide a driving circuit for a liquid crystal display device of low cost in which DRAMs are used as memories and data are read from the memories at a substantially high frame frequency.

In accordance with the present invention, there is provided a method of driving a liquid crystal display device by selecting simultaneously a plurality of lines in a liquid crystal display element characterized in that display data are temporarily stored in memories; the data are read out plural times from the memories, and arithmetic operations are performed to the read-out data to produce signals to be applied to data electrodes, wherein the picture area is divided into a plurality of picture area blocks each including scanning lines the number of which are a multiple of a natural number of simultaneously selected scanning lines;

said memories are divided into a plurality of memory blocks each having capacity capable of reading and writing data displayed on the picture area blocks;

frames for writing data into the memories are made in synchronism with frames for reading the data, a memory block undergoes a predetermined number of times of reading, and then new display data are written into said memory block.

In an aspect of the above-mentioned invention, the picture area is scanned by one continuous scanning operation;

the length of the frames for writing is n times (n: a natural number) as the length of the frames for reading; and the number of the memory blocks is increased by at least one from the number which satisfies a memory capacity required for receiving data to be written in a memory within a frame for reading data from the memory.

In another aspect of the above-mentioned invention, an upper portion and a lower portion of the picture area are driven by respectively independent scanning;

the length of the frames for writing is n-times (n: a natural number) as the length of the frames for reading, and the number of the memory blocks is increased by at least two from the number which satisfies a memory capacity required for receiving data written in a memory within a frame for reading data from the memory.

In accordance with the present invention, there is provided a driving circuit for a liquid crystal display device wherein a liquid crystal display element is driven by selecting simultaneously a plurality of lines which comprises:

memories for temporarily storing input picture image data, which include a plurality of memory blocks having capacity capable of reading and writing data to be displayed on a plurality of picture area blocks which are formed by dividing a picture area, said blocks including scanning lines the number of which are a multiple of a natural number of simultaneously selected scanning lines, a timing control means for synchronizing frames for writing data in the memories with frames for reading the data from the memories, and a memory control means for controlling writing new display data in a memory block after a predetermined number of times of reading necessary for arithmetic operation for data signals has been conducted for the memory.

The present invention provides such a technique in a memory structure to realize the multiple line selection method, and a circuit structure including the memories is made simple without reducing picture quality to thereby achieve a high picture quality and a low manufacturing cost.

The multiple line selection method features using the same data several times in a display frame. Accordingly as described before, the memories having a large capacity are necessary.

Namely, in the multiple line selection method, the same data have to be maintained in a term from the writing of certain data in the memories to the final use of the same data. If the above-mentioned condition is not satisfied, the effective value of voltages applied to liquid crystal loses accuracy and a correct display can not be expected. For this, it is necessary to maintain data in a predetermined term.

It is, of course, possible to write new data in a memory address after the last data have been read from the memory address. If a term from the reading of data at the last time to the writing new data is shortened, reduction of memory capacity is possible. In the multiple line selection methods however, the fact that the reading (i.e. scanning of picture area) speed from the memories is faster than the writing (i.e., inputting of picture image data) speed to the memories complicates memory management. Namely, it is strictly necessary to locate addresses ready for being written; to write new data in the addresses, and to record the addresses which hold the data. For this purpose, a very complicated control circuit is needed. Such complicated control results in an increased size of circuit and an increased power consumption rate, and it is difficult to employ the control circuit from a practical viewpoint.

In consideration of this viewpoint, the present invention proposes to divide a picture area and a memory space into appropriate sizes respectively (i.e. to produce picture area blocks and memory blocks) and to make the picture area correspond to the memory space whereby a simple address control system and suppression of memory size can be achieved at the same time.

At first, the picture area and the memory space are divided to form picture area blocks and memory blocks which have a picture image information size corresponding to an L×n number of scanning lines (L: number of simultaneously selected electrodes, n: an integer).

The reason that a basic unit of the blocks is L×n is as follows. Since in the multiple line selection method, signals supplied to a display element are obtained by arithmetic operation of data on an L number of scanning lines by using an orthogonal matrix, data having a unit of L lines are needed. Accordingly, if data are temporarily changed with respect to the L lines, the arithmetic operation is impossible. The present invention using a size of L×n lines as a unit allows automatically to control data for each L lines, and avoids complication of data management.

When n=1, the memory size is the smallest. In the before-mentioned example of using the double frequency·dual scan driving, memories corresponding to 1.5 picture areas are needed, and a memory size corresponding to about 1 picture area can be reduced. It is practically desirable that an additional memory block having an L×n size is added in order to completely separate writing data from reading data, whereby any signal can be treated. In a case of the single picture area driving, at least one block should be added to the memory blocks and in a case of the dual surface area driving, at least two blocks should be added whereby reading/writing can be completely separated.

In general, as the value n is smaller, a required memory capacity becomes smaller. However, addressing operations become complicated. An example of the simplest addressing method with respect to the number of times of scanning will be described below.

In the multiple line selection method, the number of times of scanning using the same data is $M=2^S$ (S: an integer, M: the smallest value of M which is at least L). Accordingly, control of memories and data can be very simple by making the number of times of scanning using the same data correspond to the division of the memory and the division of the picture area. First, the picture area (in a case of dual scan driving, an upper scan and a lower picture area should be treated separately) is divided into an M number of blocks. With respect to the memory space, an M+1 number of memory blocks are provided.

Timing of reading/writing data on the memories is determined as follows. In a term of scanning of data, the M number of memory blocks are for the blocks necessary for reading the data in the multiple line selection method, and remaining one block is for the blocks necessary for writing new data. In the next term of scanning, the block in which an M number of data reading operations have been completed is used as a block for writing, and the block which has just been for writing is now used as a block for reading. In this manner, the scanning operations and the shifting of the blocks for writing/reading are made in correspondence whereby the memory and the data can be controlled in a very simple manner. Further, the memory size can be reduced in comparison with the conventional technique.

The division to the M number of blocks is not essential, and control of the memories can be made simple by, for instance, dividing the picture area into an M×m (m: an integer) number of portions.

As a specific example, a case of double frequency dual scan driving wherein L=4 (i.e., M=4) will be explained. When an upper portion and a lower portion of the picture area are respectively divided into 4 picture areas, the requisite memory size is 1/2×5/4=0.625 picture area portions for the FRC frame to which writing operations have just been conducted, and 5/4=1.25 picture area portions for the next FRC frame, i.e., 1.875 picture area portions in total. With such a small memory size, data control for the multiple line selection method can be very simple.

In brief explanation of the essence of the present invention, the picture area and the memories are divided into several blocks, and the required capacity on the memories is brought closer to a memory capacity required when data can be written in the memories in frames which are for reading the same data from the memories. In the present invention, however, for the purpose of separating a timing of reading from a timing of writing, a larger memory capacity than the memory capacity required when the data are written in the memories in the frames for reading data from the memories, is required. Specifically, in a case of a single scan driving, the number of memory blocks should be increased by at least one from the number of the blocks which satisfies a memory capacity required when the data are written in the memories in the frames for reading the data from the memories. Further, in a case of the dual scan driving, the number of memory blocks is increased by at least two from the number of memory blocks which satisfies the memory capacity required when the data are written in the memories in the frames for reading the data from the memories.

The memory capacity required when data are written in the memories in the frames for reading the data from the memories will be described in more detail.

In a case of the single scan driving, when the length of the frames for writing data in the memories is formed to be n times (n: a natural number) as the length of the frames for reading, a memory capacity corresponding to n picture areas can be saved by allowing data to be written in the memories in the frames at the same time of reading the data from the memories in the frames. Accordingly, memories corresponding to an n number of picture areas are needed.

In a case of the dual scan driving, a memory capacity corresponding to n/2 picture areas can be saved by allowing data to be written in the memories in the frames at the same time of reading the data from the memories in the frames. Accordingly, when n is an odd number, a memory capacity corresponding to (3n+1)/4 picture areas is finally needed, and when n is an even number, a memory capacity corresponding to 3n/4 picture areas is needed.

In the present invention, a memory or memories corresponding to at least one or two blocks are added to the memories having the above-mentioned capacity for memory management.

In order to improve the quality of picture images, it is preferable to minimize influence resulting from the division of the picture area and the memories. In other words, when the picture area is divided, discontinuity of data may cause in scanning time to thereby cause reduction of the quality of display. In an extensive study of various displays in considering the above-mentioned drawback, the inventors of this application have found a preferable technique that a size of spatial modulation and a size of division, when FRC is used, can be optimized. Specifically, a danger of reducing the quality of display can substantially be avoided by determining the number of scanning lines included in a divided picture area to be a multiple of the number of scanning lines included in the size of spatial modulation. In this case, when a picture area block corresponds to the first frame display subjected to frame modulation and another picture block corresponds to the second frame display subjected to frame modulation, a display is obtainable without deteriorating a dot pattern of FRC to which the spatial modulation is applied. Namely, the division of the picture area does not adversely effect the spatially modulated FRC.

Generally, data signals are not continuous in a frame for an input picture image but they are inputted at constant intervals. For this, synchronizing signals (horizontal synchronizing signals or vertical synchronizing signals) are used. However, the timing of inputting data in the frame is not determined in a fixed sense, but there are many variations depending on manufacturers and models. In order to accommodate such flexibility of input signals, it is preferable to incorporate factors for absorbing the variations in the division of memories.

More particularly, it is a preferable technique that the size of the divided memory blocks is made larger than a value obtained by dividing the actual size of picture area by a dividing number. For instance, in a case of the dual scan driving of VGA (480 lines), i.e. 240 for each of upper and lower picture areas, and when the multiple lines selection method for selecting L=4 is used wherein the upper and lower picture areas are respectively divided into four blocks, 240/4=60 lines are used as unit. However, the picture area can be divided to have different sizes such as 24, 72 and 72 wherein 72 lines are used as unit. Thus, there is flexibility of inputting signals by dividing the picture area into blocks having different sizes and by setting the memory block sizes to the maximum size (72 lines). In this case, the writing/reading of data is possible without a complicated control to memory blocks even when there is a pose time (a time of supplying no data) of about 10% of the term in the input frame.

As a similar technique, use of an increased number of memory blocks is preferable. For instance, at least 2 blocks be added in the single scan driving, and at least 3 blocks be added in the dual scan driving.

Description has been made as to a case of using FRC as the gradation method. However, an amplitude modulation (AM) (see U.S. application Ser. No. 08/098,812 filed on Jul. 29, 1993) as the gradation method is applicable. In the AM method, however, a data signal can be divided into two data portions to achieve gradation by the amplitude modulation. Namely, two data signals are supplied to liquid crystal instead of a gradation data. Accordingly, the inputted data can not be changed in an M×2 number of times of scanning, and accordingly, the memory size required is different from a case of using only FRC. For instance, a case of displaying a picture image by converting an input frame of multiple frequency into an FRC output of two frames when a display element is driven by the multiple line selection method where L=4 is considered. In both cases, one input display frame corresponds to 2 output frames.

When a gradation display is to be effected by FRC, FRC data in 2 frames are prepared based on an input signal. The FRC data of 2 frames are respectively displayed within a display frame. Since the data of first FRC frame are used during 4 times of scanning after the writing, the data have to be maintained during a term of 4 times of scanning. However, the FRC data in the next frame are used for successive 4 times of scanning, and accordingly, the data have to be maintained during a term of 8 times of scanning.

On the other hand, when a gradation display is to be effected by amplitude modulation, the gradation display is completed in a term of 8 times of scanning. Accordingly, it is necessary to form a memory structure which holds data corresponding to one output frame during a term of 8 times of scanning.

In short, use of different gradation methods affects the size of memories required. However, the gradation methods provide the same effect on the reduction of the memory size and the simplification of the control circuit, which are essence of the present invention.

The Table described below shows circuit structures and memory sizes corresponding to the multiple line selection method in the conventional technique and the present invention.

TABLE 4

| Method | Conventional method | Present invention |
|---|---|---|
| Double frequency-dual scan driving FRC | 2.5 picture areas | 1.5 picture areas + α |
| Single scan driving FRC | 2.0 picture areas | 1.0 picture area + α |
| Amplitude modulation (Single scan driving) | 2.0 picture areas | 1.0 picture area + α |

In the Table 4, α represents a small value depend on the division of memories.

As described above, according to the present invention, the circuit structure and the memory size can be simplified without reducing the quality of display. Further, the present invention provides a circuit structure suitable for practical use, which was conventionally a big problem in using of the multiple selection method. The inventors have developed, according to the present invention, a SVGA controller having memories for providing 260 thousand colors. The display device of passive matrix type (STN) can provides substantially the same performance as a TFT type device (CR=50:1, response=60 ms (average)). An increase of manufacturing cost in comparison with the conventional STN type device is slight.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 14*a* to 14*c* are diagrams showing a method of determining a sequence of voltage waveform applied to column electrodes;

DETAILED DESCRIPTION OF THE PREFERRED EMBODIMENTS

The present invention will be described in detail with reference to drawings concerning several examples. However, it should be understood that the present invention is by no means restricted by such specific examples.

EXAMPLE 1

Figure 1:
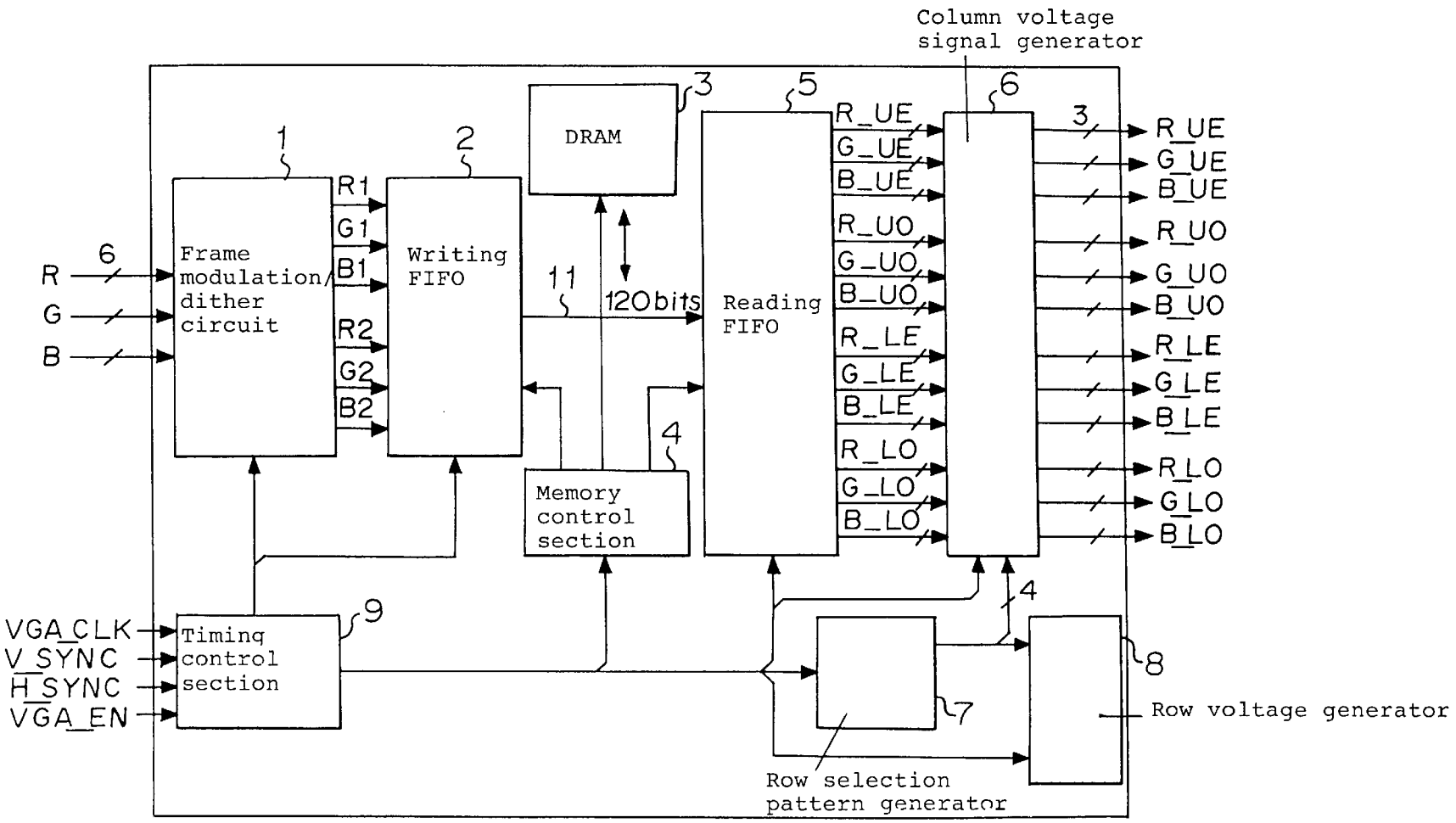
FIG. 1 is a block diagram showing an embodiment of the driving circuit for a liquid crystal display device according to the present invention.

FIG. 1 is a block diagram showing an embodiment of the construction of the driving circuit for a liquid crystal display device according to the present invention. In this, a case that a display size having 640×480 pixels (i.e., a VGA panel) are driven by a dual scanning method, is exemplified. Accordingly, the liquid crystal display panel is divided into two upper and lower portions in terms of display control. Namely, two 640×240 pixel portions are respectively driven independently. In this example, 4 lines are simultaneously selected.

The driving circuit receives input picture image data signals each having 6 bits for R, G and B, VGA clock signals (VGA_CLK) synchronized with the input picture image data signals, VGA enable signals (VGA_EN) showing the effective term of the input picture image data signals, vertical synchronizing signals (V_SYNC), horizontal synchronizing signals (H_SYNC) and so on.

In FIG. 1, input picture image data of one frame in which a pixel is constituted by 6 bits are inputted to a frame modulation/dither circuit 1 for each pixel. In fact, the data of R, G and B are inputted for each pixel. Upon receiving the input picture image data of one frame, the frame modulation/dither circuit 1 outputs display data of 2 frames in which each pixel is constituted by 1 bit in accordance with a predetermined gradation control operation. Accordingly, when the data of each pixel for R, G and B are inputted, data R1, G1, B1 each having 1 bit for R, G, B and the other data R2, G2, B2 each having 1 bit for R, G, B are outputted. Each of the data are temporarily stored in a writing FIFO2. The data in the writing FIFO2 are written in predetermined addresses in DRAM3 in accordance with instructions from a memory control section 4.

The data stored in DRAM3 are transferred to a reading FIFO5 in accordance with instructions from the memory control selection 4. The reading FIFO5 performs vertical/lateral conversion of the data to form each R, G, B data of 4 rows and 1 column for the upper portion of the liquid crystal panel and each R, G, B data of 4 rows and 1 column for the lower portion of the liquid crystal display panels and outputs these data successively to a column voltage signal generator 6. A row selection pattern generator 7 outputs a row selection pattern which corresponds to a selection matrix of 4 rows×K columns because 4 lines are simultaneously selected. The column voltage signal generator 6 conducts a predetermined arithmetic calculation based on each of the data inputted from FIFO5 and the row selection pattern generator to produce voltages to be applied to column electrodes, and outputs values corresponding to the calculated voltages to column drivers (not shown) provided at a side of the liquid crystal display panel. The value outputted to the column drivers is expressed by 3 bits.

The row selection pattern generated from the row selection pattern generator 7 is also supplied to a row voltage signal generator 8. The low voltage signal generator 8 outputs, in synchronism with the data applied to column electrodes, values indicating voltage values corresponding to the selection pattern for 4 lines of electrodes, successively to row drivers (not shown) provided at a side of the liquid crystal panel.

A timing control section 9 sends timing signals to the frame modulation/dither circuit 1, the writing FIFO2, the memory control section 4, the reading FIFO5, the column voltage signal generator 6, the row selection pattern generator 7 and the row voltage signal generator 8. An arithmetic circuit in the timing control section 9 determines x and y (which will be described hereinafter) by using the vertical synchronizing signals V_SYNC and the VGA_CLK signals.

The width of a data bus 11 extended to the writing FIFO2, DRAM3 and reading FIFO5 is 120 bits so that data of 40 bits×(all three pixels for R, G, B) are transferred by one access.

Figure 2:
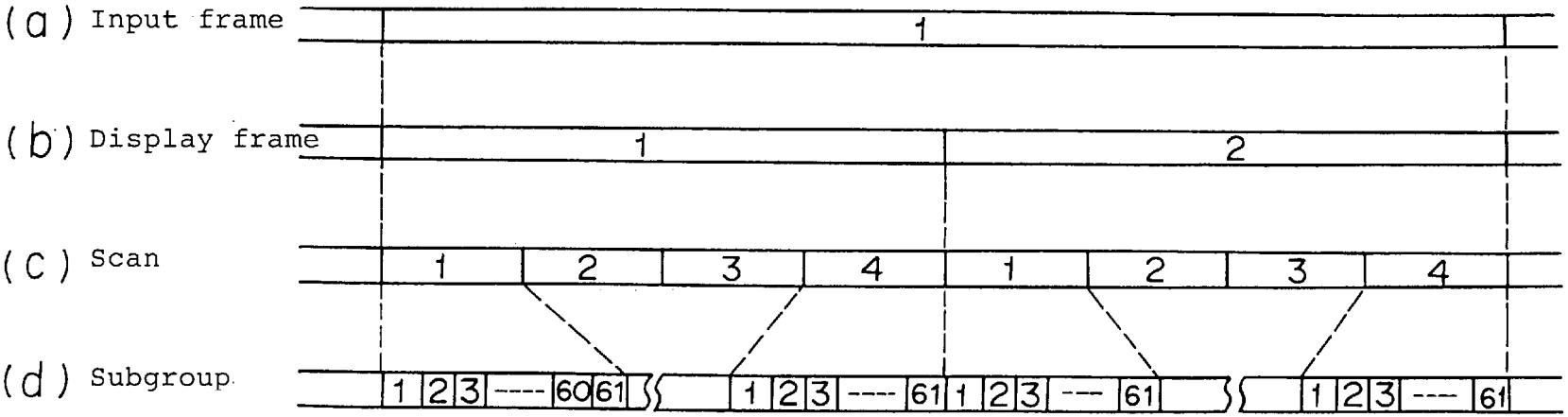
FIG. 2 is a timing chart showing a relation of an input frame for picture image, a display frame outputted from a frame modulation/dither circuit 1, a scanning signal of DRAM 3 and subgroups.

FIG. 2 is a timing chart showing a relation among an input frame for inputting a picture image, a display frame outputted from the frame modulation/dither circuit 1, scanning signals from DRAM3 and subgroups. FIG. 2*b* shows that two display frames are successively outputted. However, in fact, two display frames are outputted in parallel from the frame modulation/dither circuit 1 in one input frame term.

Figure 3:
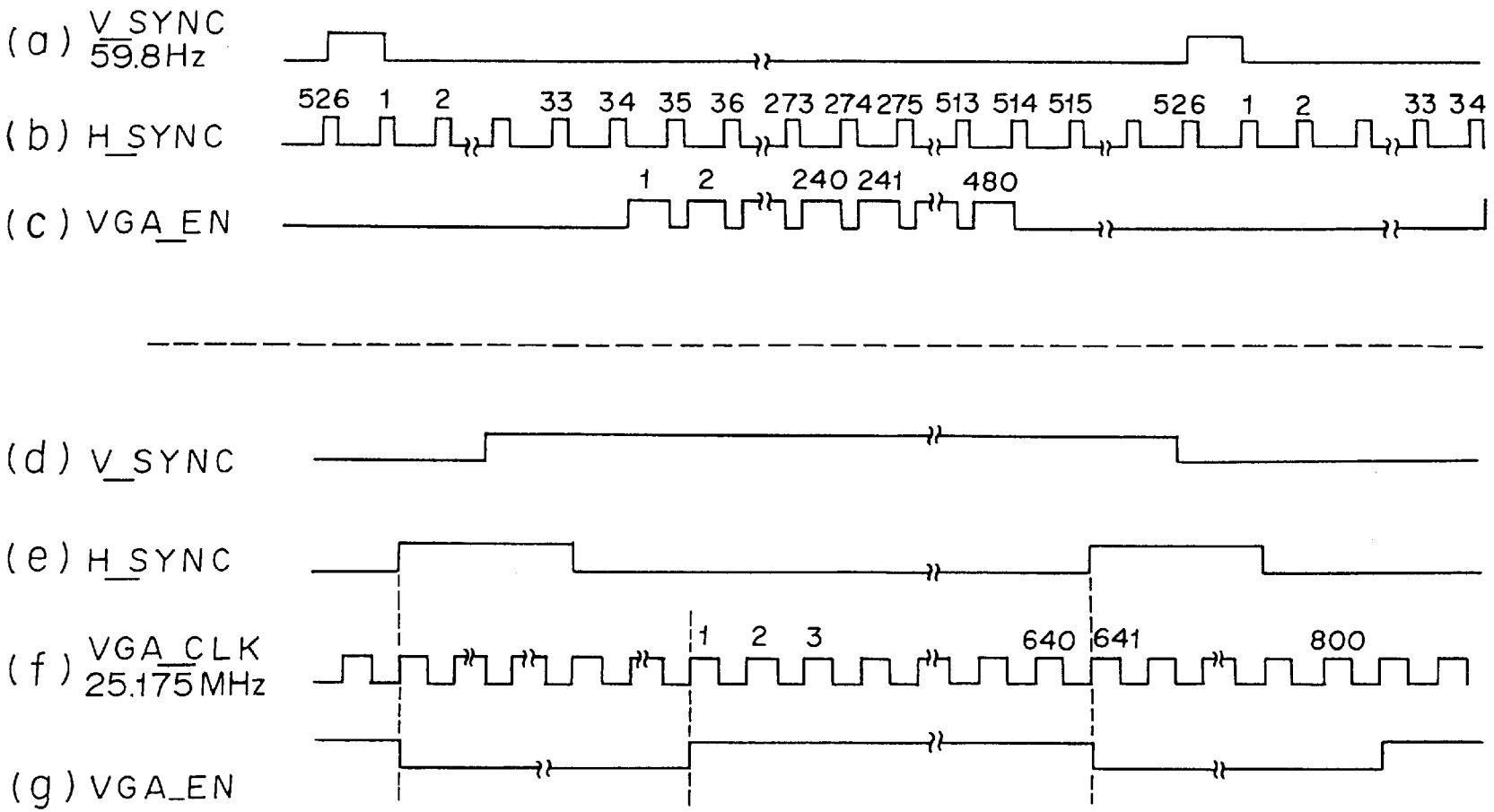
FIG. 3 is a timing chart showing input signals to a driving circuit.
Figure 4:
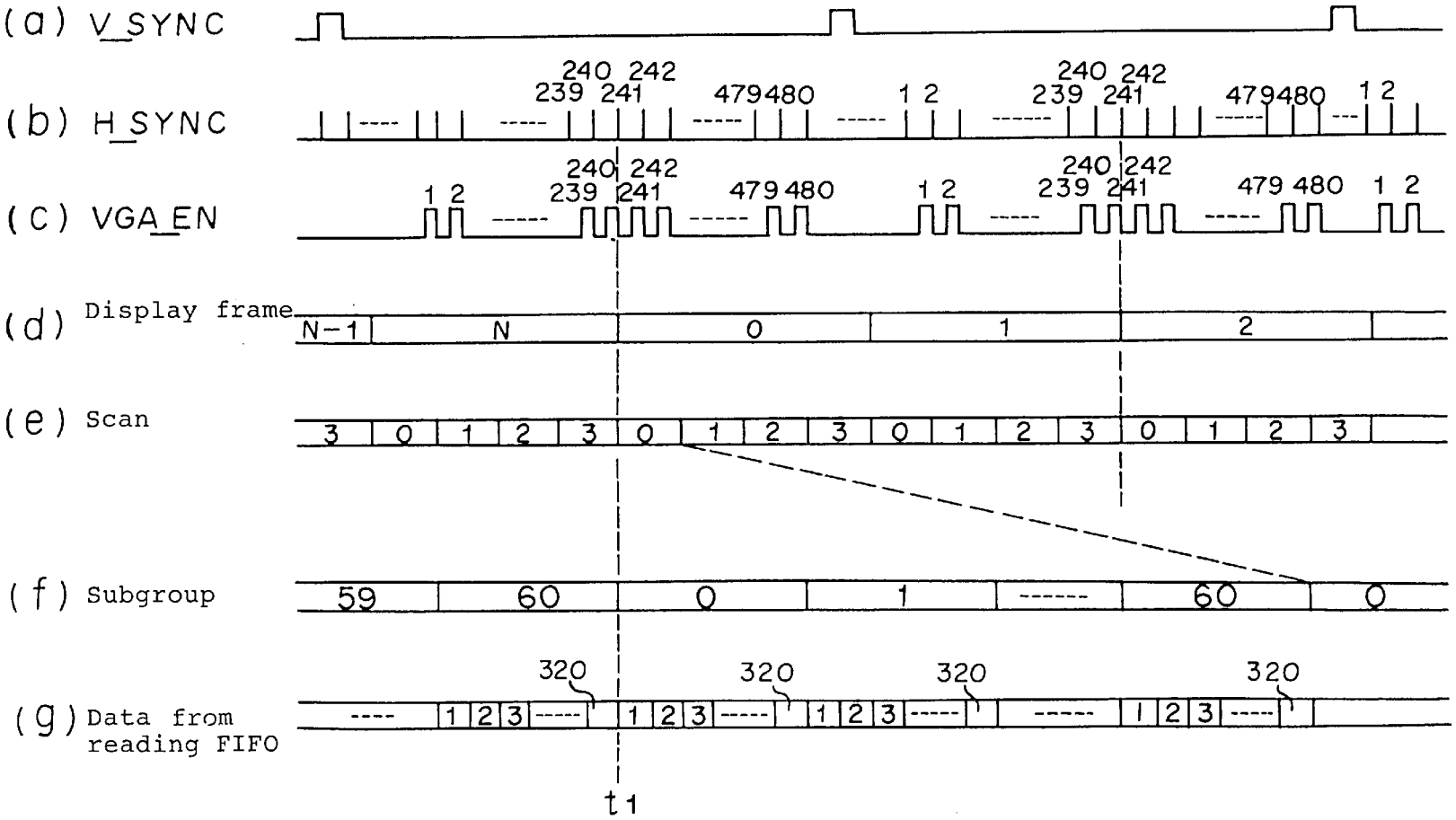
FIG. 4 is a timing chart showing a relation of a display frame, scanning signals and subgroups.

FIGS. 3 and 4 are timing charts showing timings for inputting/outputting data. As shown in FIGS. 3*a* to 3*c*, when input picture image data of one frame are inputted, there is an input of VGA_EL of 480 clocks. In a active state of VGA_EN, there is an input of VGA_CLK of 640 clocks. VGA_CLK is synchronized with the input picture image data. The timing control section 9 brings the frame modulation/dither circuit 1 and the writing FIFO2 into an operable state in response to the input of V_SYNC. The frame modulation/dither circuit 1 takes the picture image data in accordance with VGA_CLK in the operable state. Upon receiving one pixel data (for each R, G and B) constituted by 6 bits, the frame modulation/dither circuit 1 performs a predetermined arithmetic operation to produce data on two pixels (for each R, G and B) constituted by 1 bit respectively, and outputs these data into the writing FIFO2. Hereinbelow, a frame constituted by one of the pixel data produced by the frame modulation/dither circuit 1 is referred to as a first display frame, and a frame constituted by the other of the pixel data is referred to as a second display frame.

Figure 5:
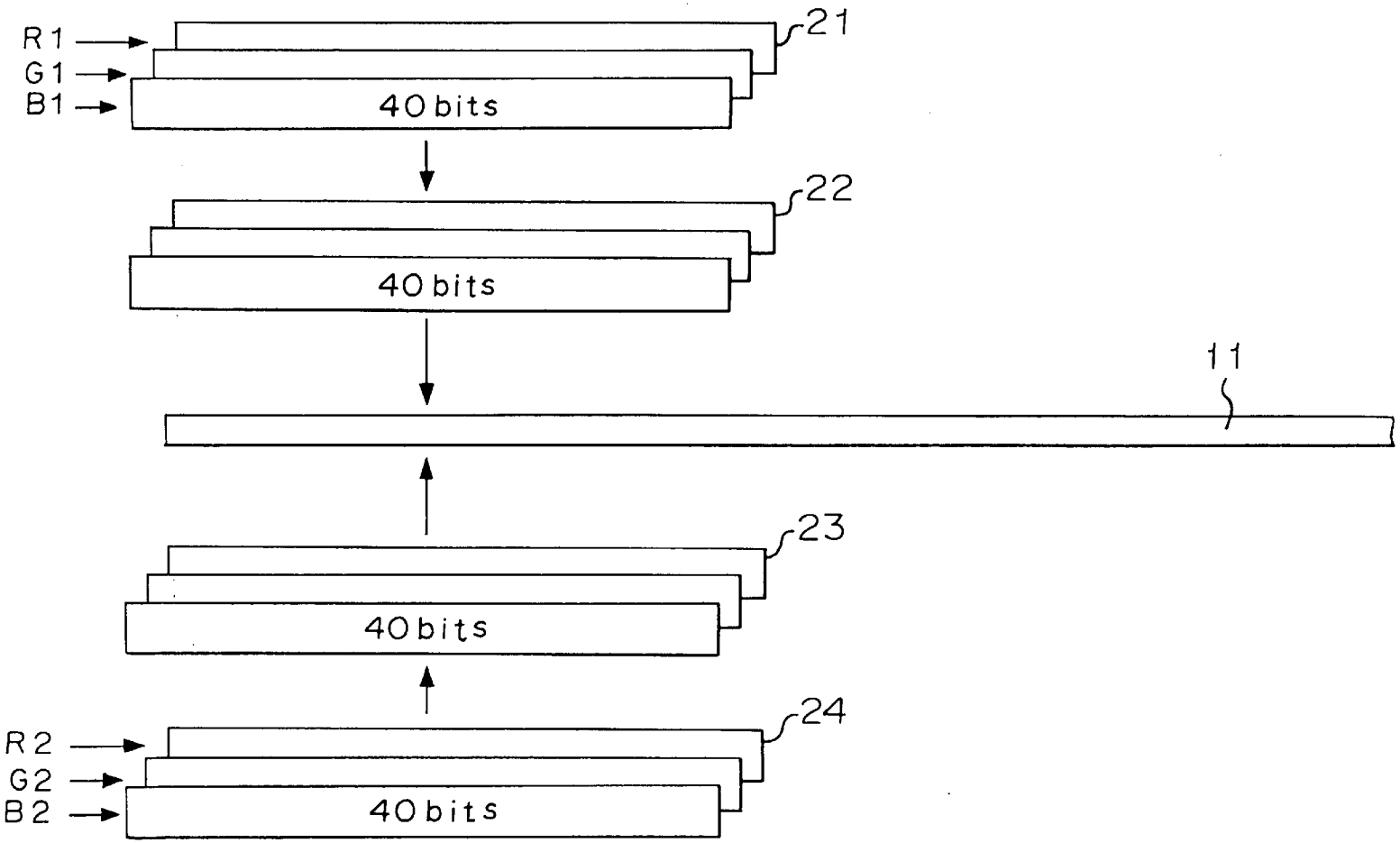
FIG. 5 is an illustration for explaining an example of the construction of a writing FIFO.

FIG. 5 is a diagram for explaining an example of the construction of the writing FIFO2. As shown in FIG. 5, the writing FIFO2 comprises shift resistors 21 of 40 bits×3 which store the pixel data of the first display frame successively, latch circuits 22 having the same size, shift resistors 24 of 40 bits×3 which store the pixel data of the second display successively, and latch circuits 23 having the same size. When 40 pixel data of the first display frame and 40 pixel data of the second display frame are inputted to the writing FIFO2, the data in the shift resistors 21, 24 are latched by the latch circuits 22, 23. The memory control section 4 controls so that the data in the latch circuits 22, 23 are successively outputted to the data bus 11, and the outputted data are written in DRAM3.

While the two display frame which are produced from one input frame are written in DRAM3, control for reading data from other regions of DRAM3 is executed. That regions store data produced from the input frame just before the input frame originated from the data which undergoes writing operation at present. As shown in FIG. 4, two display frames are produced in correspondence to one input frame (FIG. 4*d*). Since the number of simultaneously selecting lines is 4, the reading of 4 times should be conducted for each display frame (FIG. 4*e*). Each of the read frames is referred to as scanning.

When data are read from DRAM3, the data on 240 lines which constitute an upper half portion (an upper portion) of the liquid crystal display element and the data on 240 lines which constitute a lower half portion (a lower portion) are independently read. Since the number of simultaneous selection is 4, the division of 240 lines into 60 subgroups can be considered (FIG. 4*f*). Namely, the reading of 1 scanning corresponds to the reading of 60 subgroups. 1 subgroup corresponds to the reading of the data of 4 lines of the upper portion or the data of 4 lines of the lower portion. A subgroup is added as a dummy and the reading is conducted to the subgroups whereby continuity of voltages applied to the column electrodes can be expected, hence, the effect to reduce an uneven display can be expected. Practically, one scanning is constituted by 61 subgroups.

In a term constituted by 1 subgroup, the data of 4 lines for the upper portion and the data of 4 lines for the lower portion are read from DRAM3, and these data are supplied to the reading FIFO5, As shown in FIG. 1, the reading FIFO5 outputs simultaneously data on odd number columns and data on even number columns in the upper portion. It also outputs data with respect to the lower portion. Namely, the reading FIFO5 outputs simultaneously 2 (column)×4 pixel data (each pixel data includes each pixel data of R, G, B), which correspond to simultaneously selected 4 rows with respect to 2 columns, in each data of 640 columns×240 rows in the upper portion, and 2 (columns)×4 pixel data (each pixel data includes each pixel data of R, G, B) which correspond to simultaneously selected 4 rows with respect to 2 columns, in each data of 640 columns×240 rows in the lower portion. In FIG. 1, for instance, the pixel data of even number columns in the upper portion are expressed as R_UE, G_UE, and B_UE. Accordingly, as shown in FIG. 4*g*, 320 number of times of data are transferred from the reading FIFO5 to the column voltage signal generator 6 in a term constituted by 1 subgroup. The reading and the transfer of data for 2 display frames from DRAM3 to the column voltage signal generator 6 have to be controlled and to complete within a term in which 1 input frame is inputted, so as not to cause overflowing in DRAM3. Further, the reading and the transfer have to be executed under control of a predetermined timing. Such control is executed by the timing control section 9 for producing timing signals and the memory control section 4.

Figure 6:
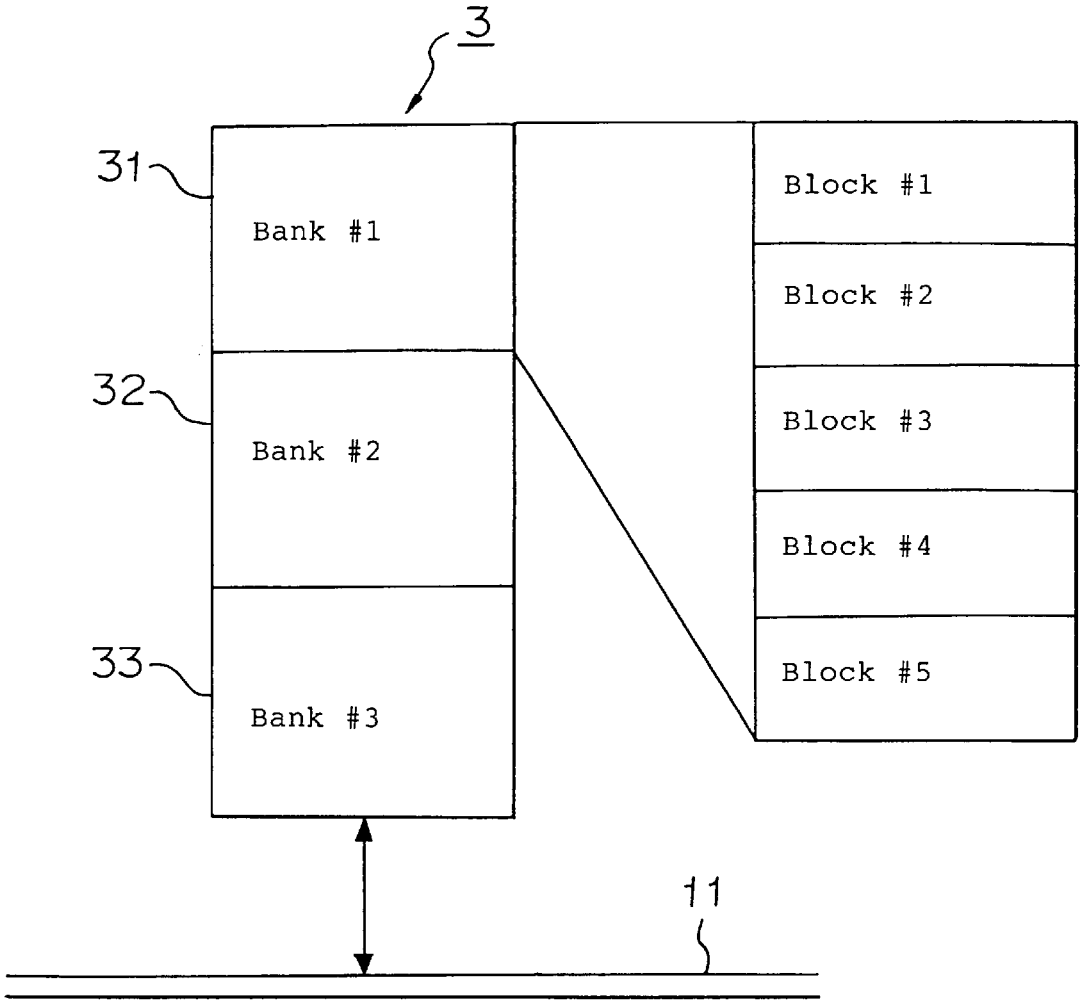
FIG. 6 is a diagram showing the spatial structure of a memory in DRAM in the first embodiment.

FIG. 6 is a diagram showing a memory spatial structure in DRAM3. In FIG. 6, the region of DRAM3 is divided into three banks 31, 32, 33, and each of the banks 31, 32, 33 is divided into 5 blocks. In a case of VGA method, a block is constituted by 72×640×3 (RGB)=138,240 bits. Accordingly, a capacity required for DRAM3 is 3×5×138,240=2,073,600 bits.

Figure 7:
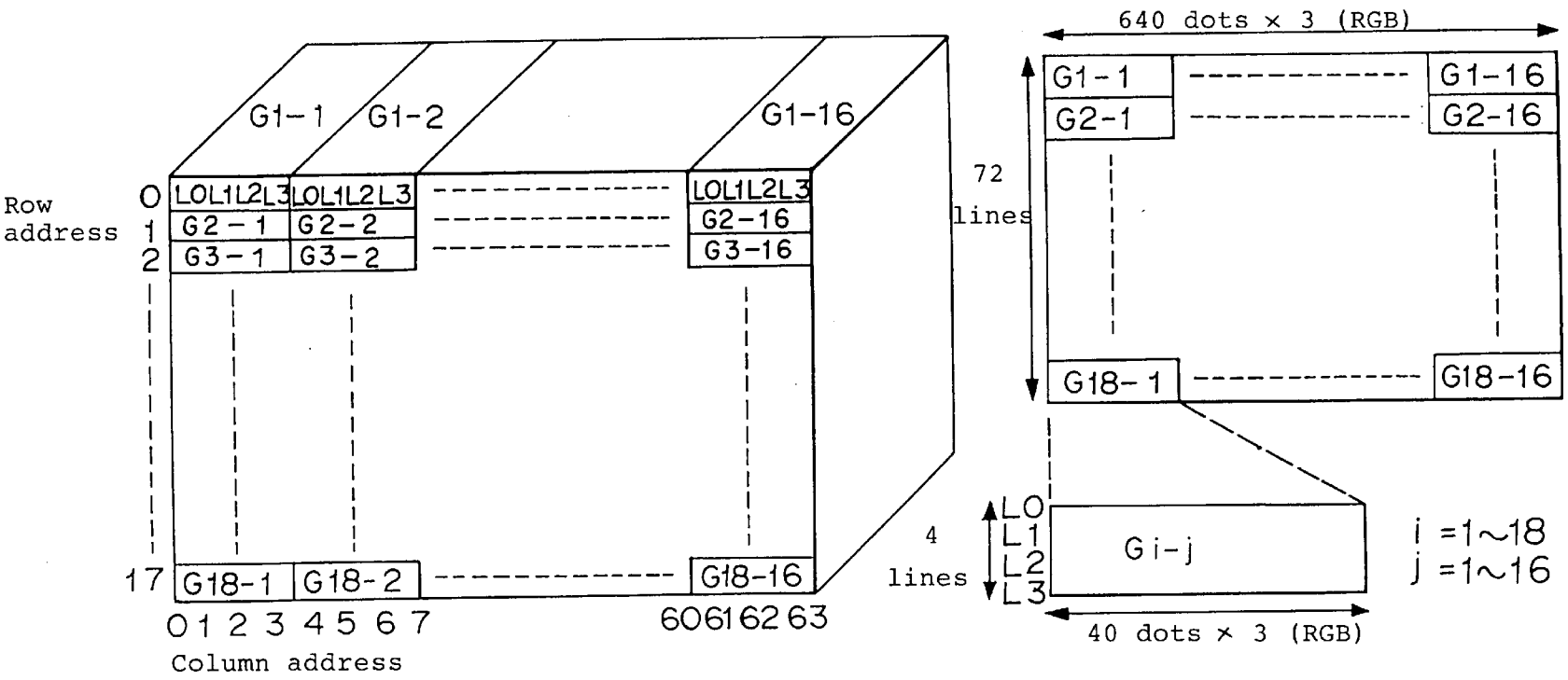
FIG. 7 is a diagram for explaining a method of storing data in a block.

FIG. 7 is a diagram for explaining a method of storing data in blocks. As sown in FIG. 7*a*, data of 40×3=120 bits as unit are set into in regions designated by column addresses 0–63 and row addresses 0–17. Accordingly, the data in a block correspond to data corresponding 72 lines as in FIG. 7*b*.

Figure 8:
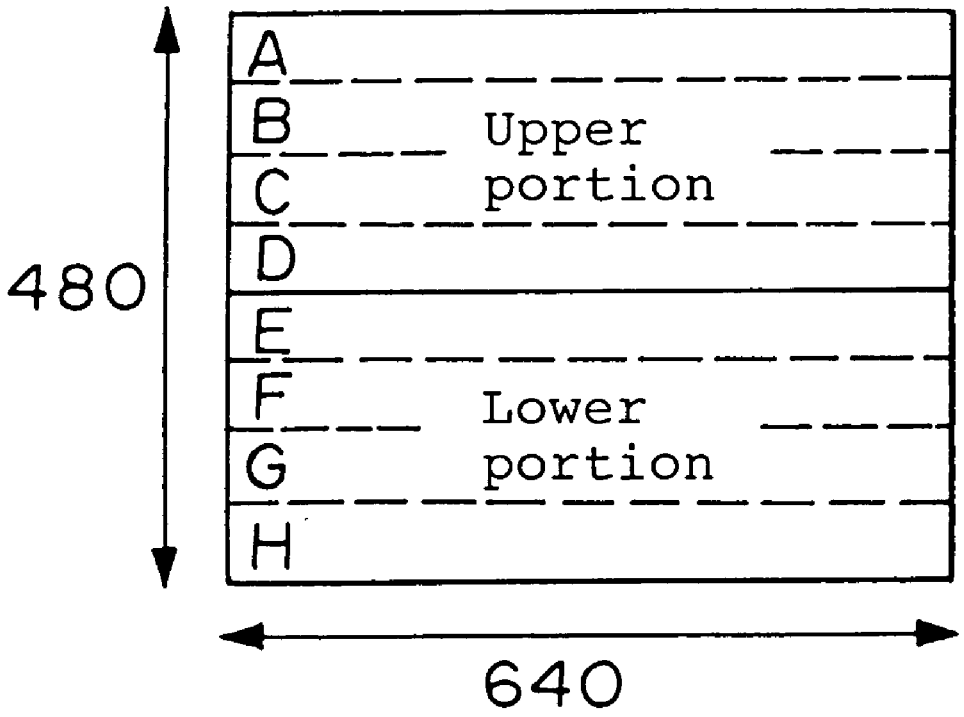
FIG. 8 is a diagram showing display regions in a liquid crystal display panel.

FIG. 8 is a diagram showing display regions in the liquid crystal display panel. An upper portion of the liquid crystal display panel is divided for control into 4 regions A, B, C and D. A lower portion is also divided for control into 4 regions E, F, G and H. The region A in the upper portion is constituted by 24 lines, and the other regions are respectively constituted by 72 lines. The region H in the lower portion is constituted by 24 lines, and the other regions are respectively constituted by 72 lines.

Figure 9:
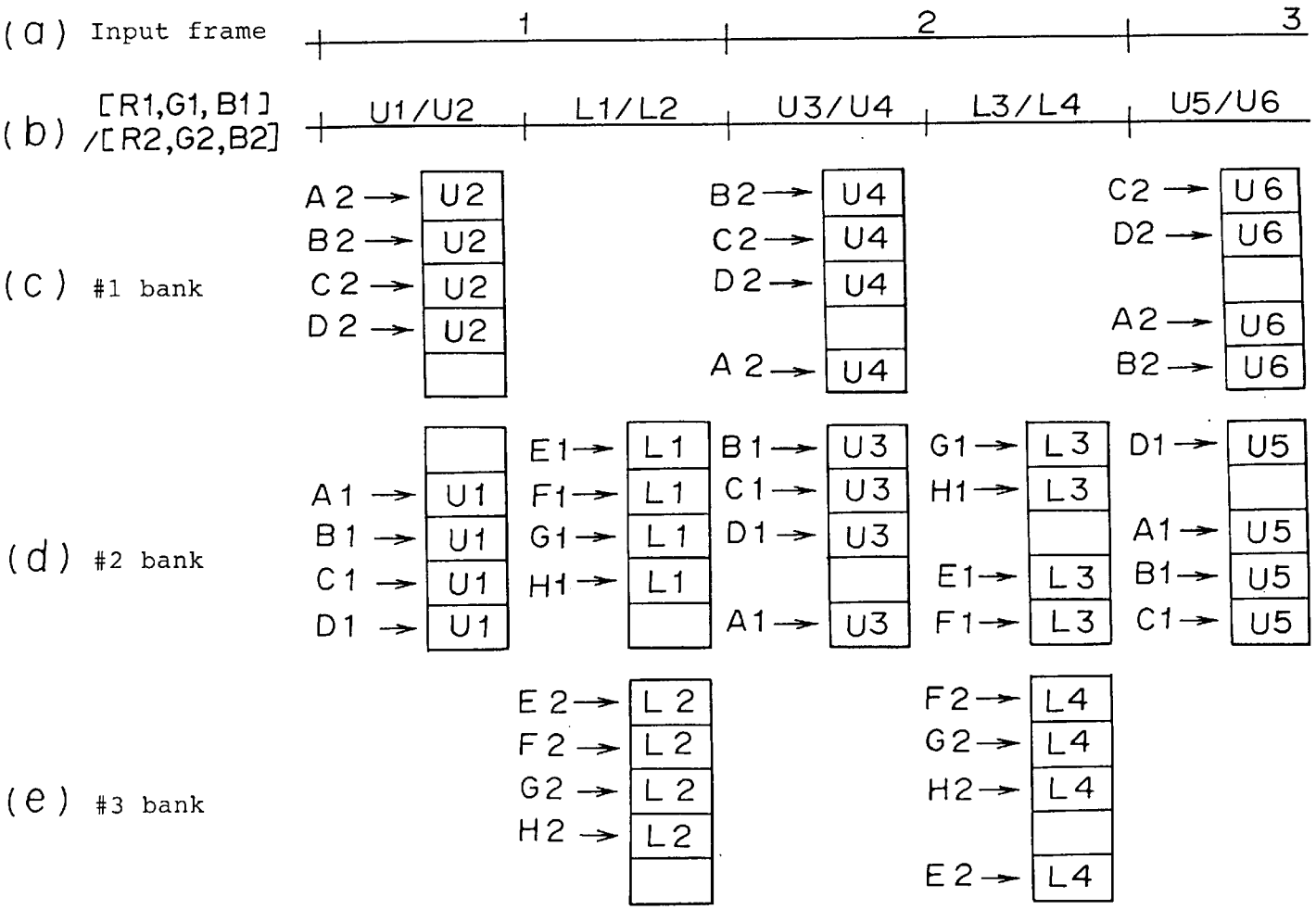
FIG. 9 is a diagram showing a method of writing data in DRAM in the first embodiment.

Operation will be described with reference to FIG. 9 which is a diagram showing a method of writing data in DRAM3. In FIG. 9, for instance, A1 designates data displayed in the region A of the upper portion of the liquid crystal display panel, in the first display frame. U1 designates the first display frame to be displayed in the upper portion of the liquid crystal display panel. L1 designates the first display frame to be displayed in the lower portion of the liquid crystal display panel. In FIG. 9 #1 bank 31 is to store display frames to be displayed in the upper portion of the liquid display panel, and #3 bank 32 is to store display frames to be displayed in the lower portion of the liquid crystal display panel. #2 bank 33 is to store display frames to be displayed in the upper portion or the lower portion of the liquid crystal display panel.

Picture image data from a personal computer or the like are inputted to the frame modulation/dither circuit 1 in accordance with the order of lines. The frame modulation/dither circuit 1 outputs data which form both the first display frame and the second display frame. The data of the first display frame are inputted to the shift resistor 21 of the writing FIFO2, and the data of the second display frame are inputted to the shift resistor 24 of the writing FIFO2. When data are set in the latch circuits 22, 23 of the writing FIFO2, the memory control section 4 controls so that the data are successively outputted from the writing FIFO2 to the data bus 11. As shown in FIGS. 9*a* and 9*b*, the frame modulation/dither circuit 1 outputs data of 2 display frame in parallel in one cycle term of input frames. In early half terms, picture image data to be displayed in the upper portion of the liquid crystal display panel in the first and the second display frames are outputted.

As shown in FIGS. 9*c* to 9*e*, the memory control section 4 performs control of write-addressing in such a manner that for instance, data corresponding to the initial 24 lines of the first display frame (data corresponding to the region A of the first display frame=A1) are set in the block #2 of #2 bank 32 in DRAM3. Further, it performs control of write-addressing in such a manner that the data corresponding to the initial 24 lines of the second display frame (data corresponding to the region A of the second display frame=A2) are set in the block #1 of #1 bank in 31 in DRAM3. As shown in FIG. 7, the memory control section 4 gives instructions to store successively data on 10 pixels in column addresses "0" to "63" in a row address "0". Then, when data are set in the column address "63", data on 10 pixels are respectively set to each region in a row address "1".

Then, the memory control section 4 performs control of the write-addressing so that data corresponding to the next 72 lines of the first display frame (data corresponding to the region B of the first display frame=B1) are set in the block

#3 of #2 bank 32 in DRAM3. Further, it performs control of write-addressing so that the data corresponding to the next 72 lines of the second display frame (the data corresponding to the region B of the second display frame=B2) are set in the block #2 of #1 bank 31 in DRAM3.

Then, the memory control section 4 performs control of write-addressing so that the data corresponding to the next 72 lines of the first display frame (the data corresponding to the region C of the first display frame=C1) are set in the block #4 of #2 bank 32 in DRAM3. Further, it performs control of write-addressing so that the data corresponding to the next 72 lines of the second display frame (the data corresponding to the region C of the second display frame=C2) are set in the block #3 of #1 bank 31 in DRAM3.

Continuously, the memory control section 4 performs control of write-addressing so that the data corresponding to the next 72 lines of the first display frame (the data corresponding to the region D of the first display frames=D1) are set in the block #5 of #2 bank 32 in DRAM3. Further, it performs control of write-addressing so that the data corresponding to the next 72 lines of the second display frame (the data corresponding to the region D of the second display frame=D2) are set in the block #4 of #1 bank 31 in DRAM3.

Thus, data of one display frame are stored in predetermined regions in DRAM3.

Operations of reading data from the memories are conducted in parallel to the above-mentioned operations for writing data in the memories. Strictly speaking, the operations of reading data from the memories are conducted in a term wherein the writing of the data in the writing FIFO2 to DRAM3 are not conducted, i.e., in a term in which data from the frame modulation/dither circuit 1 are passed in the shift resistors 21, 24 of the writing FIFO2.

Figure 10:
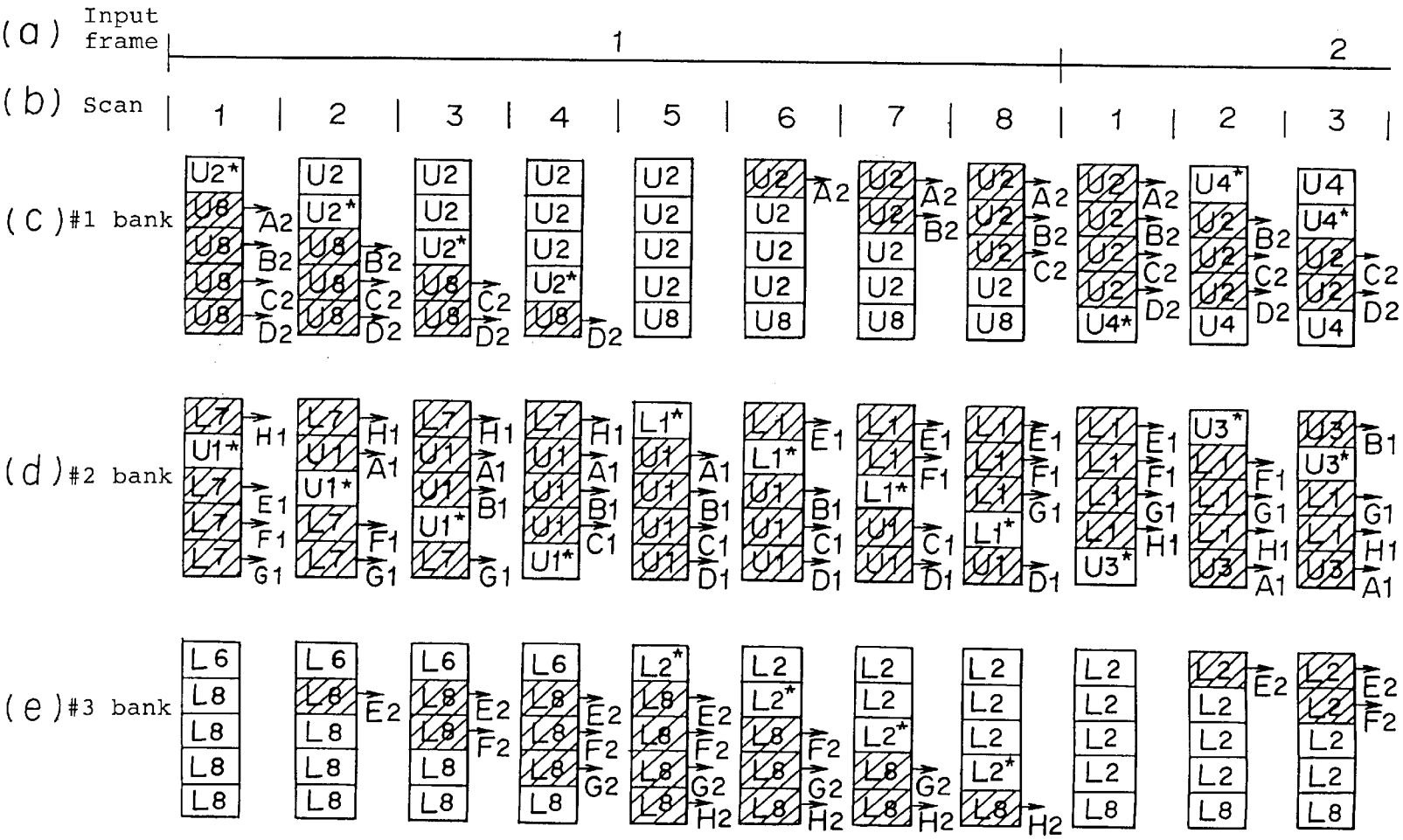
FIG. 10 is a diagram showing how data are written in each block of DRAM and how data are read from the blocks in the first embodiment.

FIG. 10 is a diagram showing how data are written in each block of DRAM3 and how the data are read from DRAM3. FIG. 10 shows that the data are read from the blocks having hatched lines, and data are written in the blocks with a mark *. For instance, in the first through the fourth scanning terms in the first input frame term, picture image data (A1, B1, C1, D1) of the upper portion of the first display frame are successively written in #2 bank 32, and picture image data (A2, B2, C2, D2) of the upper portion of the second display frame are successively written in #1 bank 31.

In these terms, the memory control section 4 performs control of reading of the data, which are already set, from the blocks to which writing operations are not conducted. The read data are supplied to the reading FIFO5. As shown in FIGS. 10*c* to 10*e*, in one scanning term, data are read from 4 blocks in which data to be displayed are set for the 4 regions of the upper portion of the liquid crystal panel and 4 blocks in which data to be displayed are set for 4 regions of the lower portion, i.e., the data are read from 8 blocks in total. Accordingly, 4 times of reading of the data are executed from each of the blocks in which data to be displayed in each of the regions are set in 4 scanning terms=1 display frame term.

The reading FIFO5 has 4 systems of resistors each corresponding to columns of even-number in the upper portion, columns of odd number in the upper portion, columns of even number in the lower portion and columns of odd number in the lower portion of the liquid crystal display panel. In each of the resistors, picture image data on each of the columns with respect to simultaneously selected four rows are set. And the reading FIFO5 outputs to the column voltage signal generator 6 in response to a timing control by the timing control section 9, picture image data on selected rows corresponding to the columns of even number in the upper portion, columns of odd number in the upper portion, columns of even number in the lower portion and columns of odd number in the lower portion of the liquid crystal display panel. The column voltage signal generator 6 performs an exclusive OR arithmetic operation between the selection patterns from the row selection pattern generator 7 and the picture image data of 4 row·1 column on the 4 systems, and a value obtained by summing values resulted from the arithmetic operations is outputted. The data on the columns of even number in the upper portion are outputted to system for driving columns of even number of column drivers (not shown), and data on the columns of odd number in the upper portion are outputted to a system for driving columns of odd number of the column drivers. Further, data on the columns of even number in the lower portion are outputted to a system for driving columns of even number of the column drivers, and data on the columns of odd number of the lower portion are outputted to a system for driving columns of odd number of the column drivers.

As shown in FIG. 4*f*, 60 number of times of driving of row electrodes (selection of subgroups) are respectively conducted for the upper portion and the lower portion of the liquid crystal display panel in one scanning term. Since 4 lines are simultaneously driven in one time of driving of row electrodes, 240 lines of low electrodes are respectively driven for the upper portion and the lower portion in one scanning term. Namely, the driving of the row electrodes are conducted for the entire lines. However, as described later, 61 number of times of reading are performed in DRAM3 in one scanning term. Further, as shown in FIG. 4*g*, 640/2 (an even number column, an odd number column)=320 number of times of data transfer from the reading FIFO5 to the column voltage signal generator 6 are conducted while one subgroup is selected.

As shown in FIG. 4*f*, the reading of the dummy is conducted in the selection of the $60_{th}$ subgroup. The column voltage signal generator 6 performs an exclusive OR arithmetic operation between the selection patterns from the row selection pattern generator 7 and the picture image data of 4 row·1 column on 4 systems which are read in the reading of the dummy, and a value obtained by summing values in the arithmetic operation is outputted. Outputs on the columns of even number in the upper portion are supplied to the system for driving columns of even number of the column drivers, and outputs on the columns of odd number in the upper portion are supplied to the system for driving columns of odd number of the column drivers. Further, outputs on the columns of even number in the lower portion are supplied to the system for driving columns of even number of the column numbers, and outputs on the columns of odd number in the lower portion are supplied to the system for driving columns of odd number of the column drivers. In this case, however, the row voltage signal generator 8 does not drive any row electrode.

Such control provides continuity between a column voltage to be applied at the next subgroup selection term and the column voltage applied just before. Accordingly, a non-uniformity of display can be reduced.

In the above-mentioned example, a case of driving the VGA panel has been described. However, the driving circuit used in this example can also be applied to driving another type of liquid crystal display panel. For instance, it can be applied to a case of driving a SVGA panel having 800×600 pixels. In a case of driving the SVGA panel, 1 block is constituted by 84×800×3 (RGV)=201,600 bits. Accordingly, a capacity required for DRAM3 is 3×5×201,600=3,024,000 bits. In this case, the number of subgroups (including a subgroup for reading a dummy) is 77, and the number of times of reading FIFO5 in one subgroup term is 400.

Figure 16:
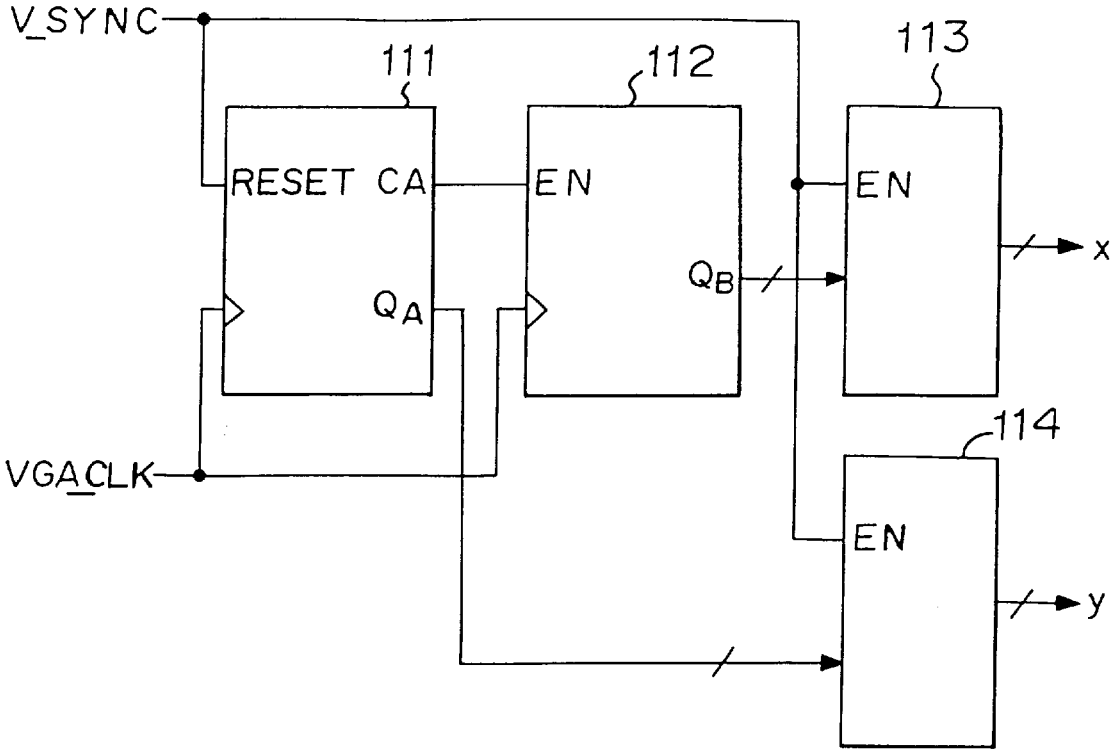
FIG. 16*a* is a block diagram showing an embodiment of an arithmetic circuit in a timing control section.
FIG. 16*b* is a diagram for explaining x and y produced by the arithmetic circuit.
Figure 16:
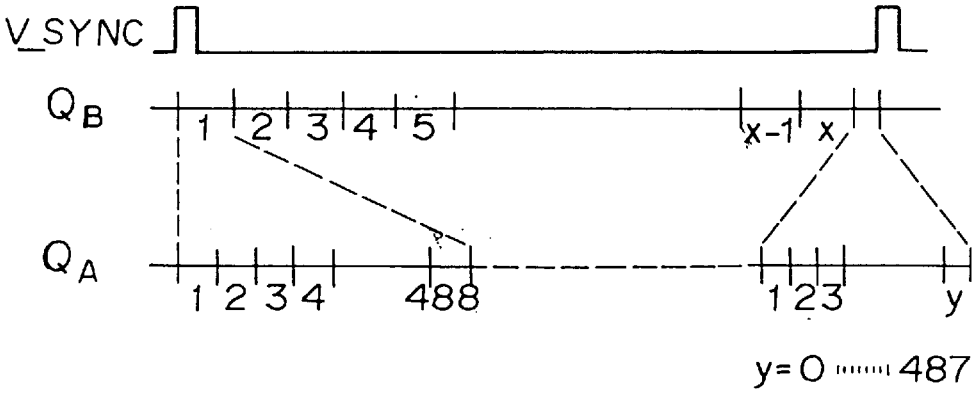
Figure 17:
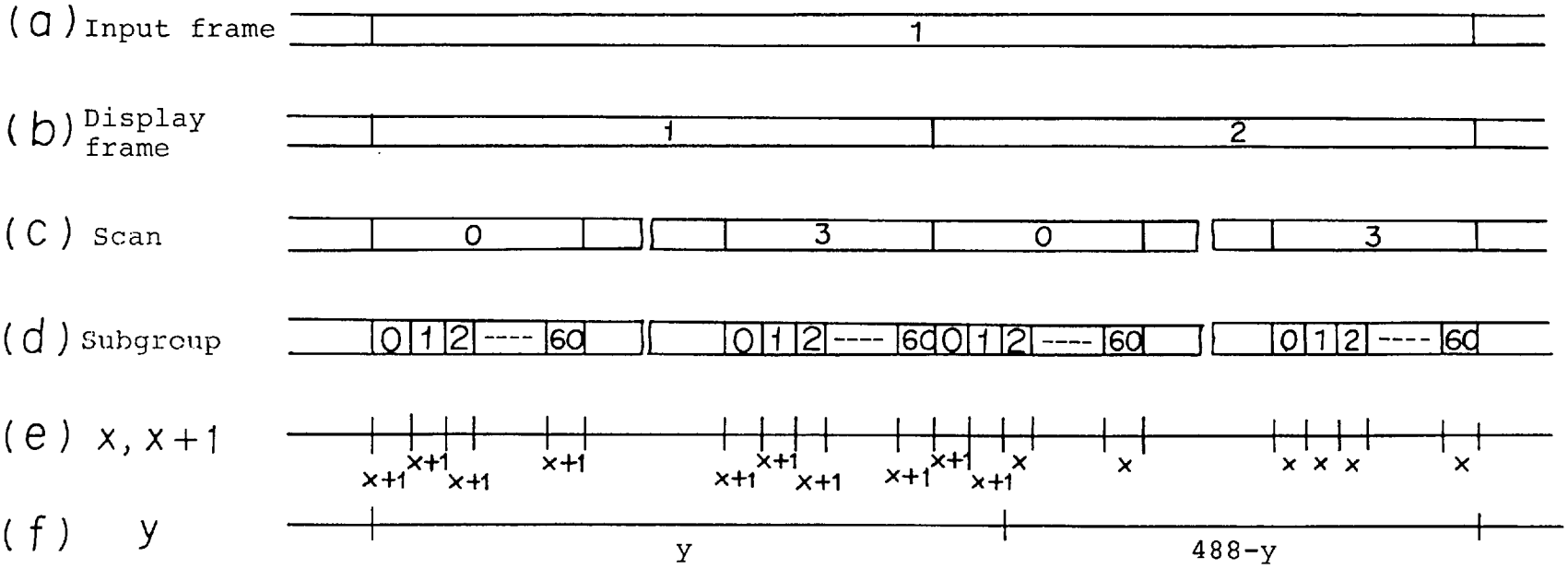
FIG. 17 is a timing chart showing a relation of x and y produced by the arithmetic circuit to scanning signals.

Description will be made on timing control in this example. FIG. 16*a* is a diagram showing an embodiment of an arithmetic circuit in the timing control section 9. When a power source is connected, values of x and y as shown in FIGS. 17*e* and 17*f* are determined. As described before, 60 number of times of driving are effected to row electrodes respectively in the upper and lower portions of the liquid crystal display panel in one scanning term. Since 4 lines are simultaneously driven in one time of driving of row electrodes, 240 lines of row electrodes are driven respectively in the upper and lower portions in one scanning term. Namely, the entire lines of row electrodes are driven. Since one frame term corresponds to 8 scanning terms, 60×8=480 times of driving of row electrodes are possible in one input frame term. Accordingly, it is preferable that the one input frame term is divided uniformly into 480 row electrode selection intervals. However, since the subgroup for a dummy exists once in each scanning term, the one input frame term is practically divided uniformly into 488 row electrode selection intervals.

In this example, each of the row electrode driving terms is determined based on VGA_CLK signals. Namely, the number of clock corresponding to one row electrode driving term can be obtained by dividing the number of VGA_CLK which are inputted between the input time point of a certain V_SYNC and the input time point of the next V_SYNC by 488. Since the number of VGA_CLK inputted between the two V_SYNC signals does not correspond to a multiple number of 488, a row electrode driving term corresponding to VGA_CLK for x and row electrode driving term corresponding to VGA_CLK for x+1 are produced. The number of the row electrode driving terms corresponding to x+1 in the one input frame term is y. The arithmetic circuit determines the values of x and y as defined in the above. Since the values of x and y are determined based on V_SYLC and VGA_CLK inputted in one input frame, the reading of data from the memories and the driving of electrodes are possible using the multiple line selection method even when any value of frequency for input picture signals is used.

In the arithmetic circuit having the construction shown in FIG. 16*a,* an A-counter 111 is once reset by V_SYNC. Namely, counting is initiated at the input time point of V_SYNC. When 488 number of VGA_CLK are counted, a carry signal is outputted. The carry signal of the A-counter 111 is a count enable signal to a B-counter 112. Since the count enable signal becomes significant for 1 cycle of VGA_CLK, VGA_CLK of 1 clock is inputted to the B-counter 112 during the significant term. Namely, a value of 1 is added to a value counted by the B-counter 112. Then, the A-counter 111 starts to count from the initial value of 0.

Accordingly, as shown in FIG. 16*b,* the count value of the B-counter 112 shows the number of times of inputting VGA_CLK each having 488 clocks. The above-mentioned operations are repeated. Then, when V_SYNC is inputted, the count value of the B-counter 112 is latched by a latch circuit 113. On the other hand, the count value of the A-counter 111 is latched by a latch circuit 114. The value latched by the latch circuit 113 indicates the number of times of VGA_CLK each having 488 clocks which is inputted between the input time point of a certain V_SYNC and the input time point of the next V_SYLC, i.e., one input frame term. The value latched by the latch circuit 114 shows a fractional value which is less than 488 clocks.

Accordingly, [a value latched by the latch circuit 113)× 488+[a value latched by the latch circuit 114] shows the number of VGA_CLK inputted in one input frame term. Namely, when [a value latched by the latch circuit 113] is x and [a value latched by the latch circuit 114] is y, [the number of VGA_CLK inputted in one input frame term]= (x+1)×y+(x)×(488−y) is satisfied. Accordingly, the values x and y as in the above-mentioned definition can be obtained. Each of the values x and y thus determined is supplied to the timing control section 9.

Figure 18:
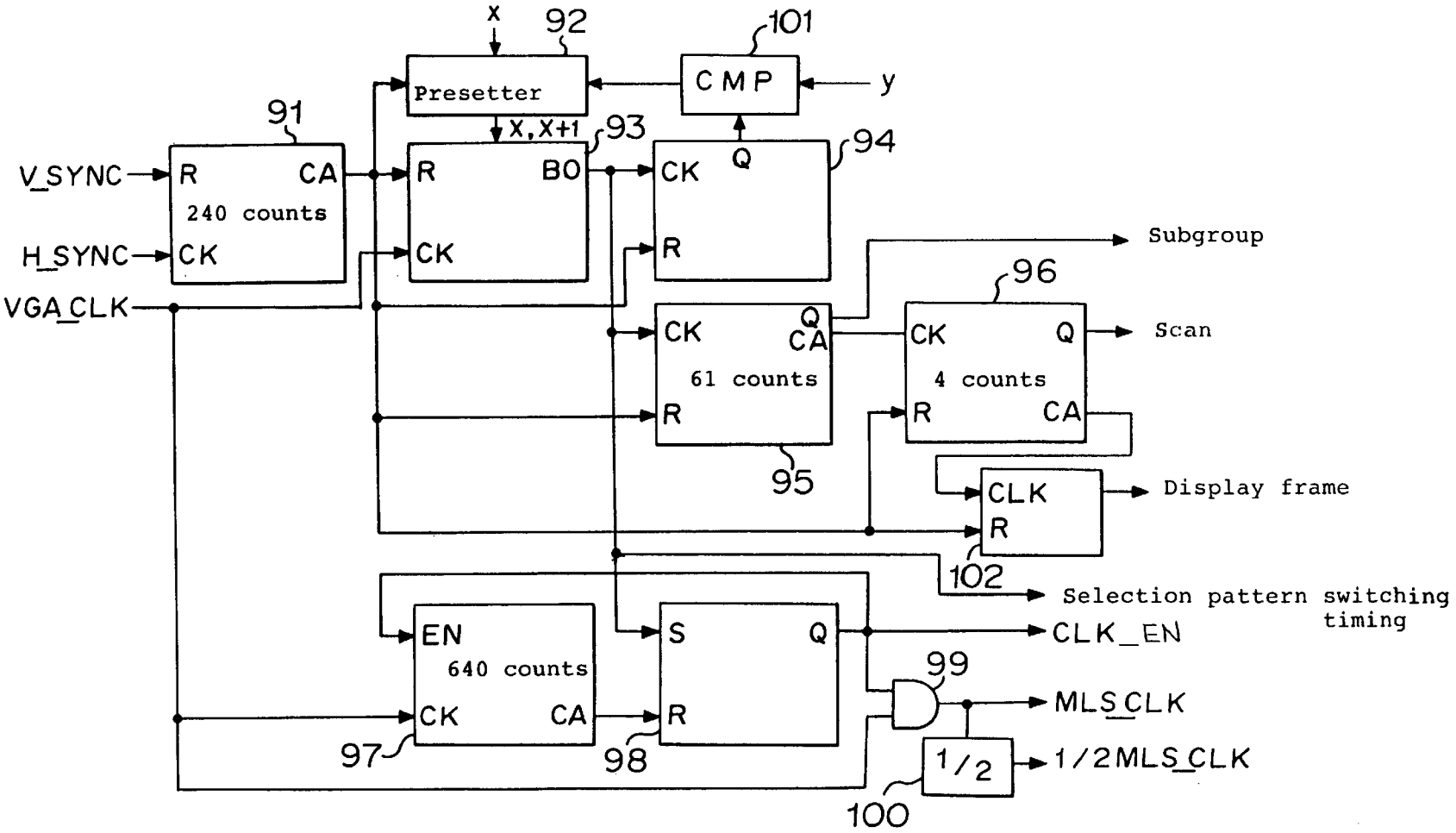
FIG. 18 is a block diagram showing an embodiment of the structure of the timing control section.

FIG. 18 is a block diagram showing an embodiment of the timing control section 9. A counter 91 is reset by V_SYNC to start counting of the number of clocks of H_SYNC. When the count value reaches "240", the counter 91 outputs a carry signal. The output of the carry signal corresponds to the time point of t1 in FIG. 4. This time point provides the reference for reading data from the reading FIFO5 and starting of timing control for driving the liquid crystal display panel. Namely, the time point locates at the middle in a term in which 480 VGA_EN are inputted as shown in FIG. 4. Thus, by using the middle point of the term in which VGA_EN are inputted as a reference point of the reading of the data and the starting of timing control for driving the liquid crystal display panel, the memories can be efficiently used, specifically, a region corresponding to a picture area in DRAM3 can be half.

Upon receiving the output of carry signal from the counter 91, a counter 93 starts counting-down from a set value. The set value is provided by a presetter 92. The presetter 92 initially sets a value (x+1) in the counter 93. When the counter 93 counts a (x+1) number of VGA_CLK signals, a borrow signal is generated at the time point when one subgroup term has passed. Borrow signals are supplied as clock signals to counters 94, 95. The counter 95 produces a carry signal when 61 input clocks are counted. The time point of producing the carry signal is the time point when one scanning term is completed. Counted values in the counter 94 are compared with y in a comparator 101. When these values agree with each other, the presetter 92 changes the set value to be supplied to the counter 93 to the value x.

The counter 95 counts borrow signals from the counter 93. Accordingly, the counted value indicates a value showing a number of subgroup (FIG. 17*d*). When the counter 95 counts 61 input clock signals, a carry signal is produced. Carry signals from the counter 95 are supplied as clock signals to a counter 96. Accordingly, a counted value in the counter 96 indicates a value showing a number of scanning (FIG. 17*c*). Carry signals from the counter 96 are supplied as clock signals to a counter 102. Accordingly, a count value by the counter 102 indicates a value showing the number of display frame (FIG. 17*b*).

Figure 19:
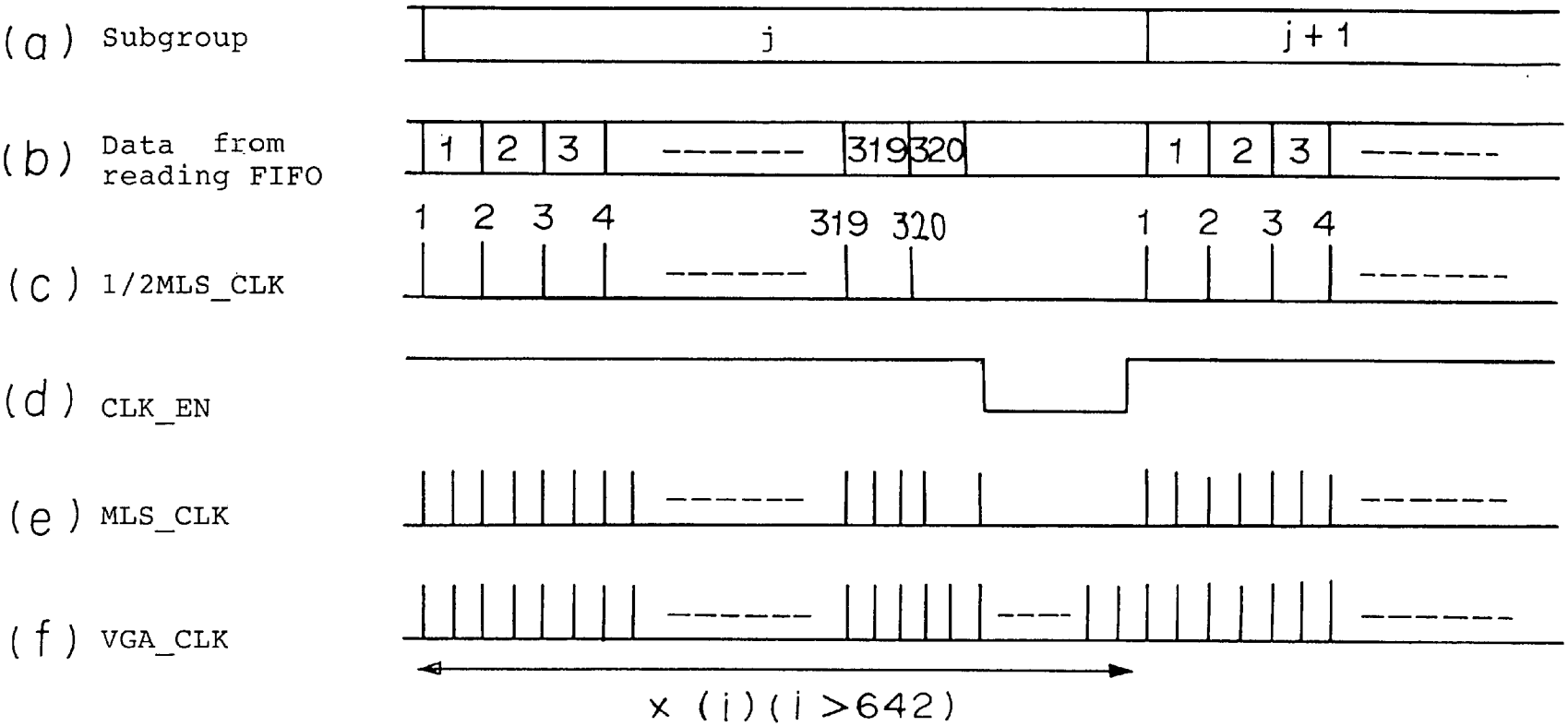
FIG. 19 is a timing chart showing a relation of subgroups to 1/2MLS_CLK.

Upon receiving the output of carry signal from the counter 91, a counter 97 starts counting of VGA_CLK. When it counts 640 VGA_CLK signals, it stops the counting so that the output from a flip-flop is rendered to be a non-active state. The output of the flip-flop 98 corresponds to CLK_EN shown in FIG. 19*d*. Accordingly, VGA_CLK signals inputted to an AND circuit 99 which receives CLK_EN as gate signals, are outputted as MLS_CLK as shown in FIG. 19*e*. The MLS_CLK are divided by a divider 100 into 1/2 MLS_CLK.

Thus, the numbers of scanning as shown in FIG. 17*c,* the numbers of subgroups as shown in FIG. 17*d,* timing as shown in FIG. 17*e,* the 1/2 MLS_CLK as shown in FIG. 19*c* and the MLS_CLK as shown in FIG. 19*e* are obtainable. The signals and the timing thus obtained are supplied to the frame modulation/dither circuit 1, the writing FIFO2, the memory control section 4, the reading FIFO5, the column voltage signal generator 6, the row selection pattern generator 7 and the row voltage signal generator 8.

Thus, the column voltage signal generator 6 takes data stored in the reading FIFO5 corresponding to the 1/2 MLS_CLK as shown in FIGS. 19*b* and 19*c*. At the same time, the row selection pattern generator 7 outputs a row selection pattern to the column voltage signal generator 6. The row selection pattern generator 7 performs exclusive OR operations for each bit of data each having 4 bits of even number columns in the upper portion, odd number columns in the upper portion, even number columns in the lower portion and odd number columns in the lower portion and data of inputted row selection patterns. Values obtained by the operations are summed, and the summed values are outputted to the column drivers. At the same time, the row selection pattern generator 7 outputs a row selection patterns to the row voltage signal generator 8. The row voltage signal generator 8 drives row electrodes by means of the row drivers during one term as shown in FIG. 17*e*. The one term in FIG. 17*e* is, for instance, determined as a term from the output time point of a borrow signal from the counter 93 to the output time point of the next borrow signal.

The memory control section 4 performs the control of the reading of data in DRAM3 by using the MLS_CLK. Further, it transfers data from the writing FIFO2 to DRAM3 in a term in which the CLK_EN is not in an active state.

As described above, since the driving circuit is so constructed that the data are transferred from DRAM3 to the liquid crystal display panel in synchronism with the MLS_CLK, control of the timing can be accurate in comparison with that in the conventional circuit. Further, since the time point as reference in controlling the timing is determined apart from the time point of an input of V_SYNC, dispersion of the V_SYNC does not substantially occur. Further, since the timing operation is not conducted in a term in which a picture image signal is not inputted at the time just before or just after an input of the V_SYNC, the region of DRAM3 can be utilized effectively.

In this example, the case of VGA for displaying 640×480 pixels has been explained. However, picture image signals according to SVGA or another system can be treated. In these cases, each value of x and y and count values in each of the counters are different. However, the same idea of synchronizing data as described in the first example can be applied.

EXAMPLE 2

Figure 11:
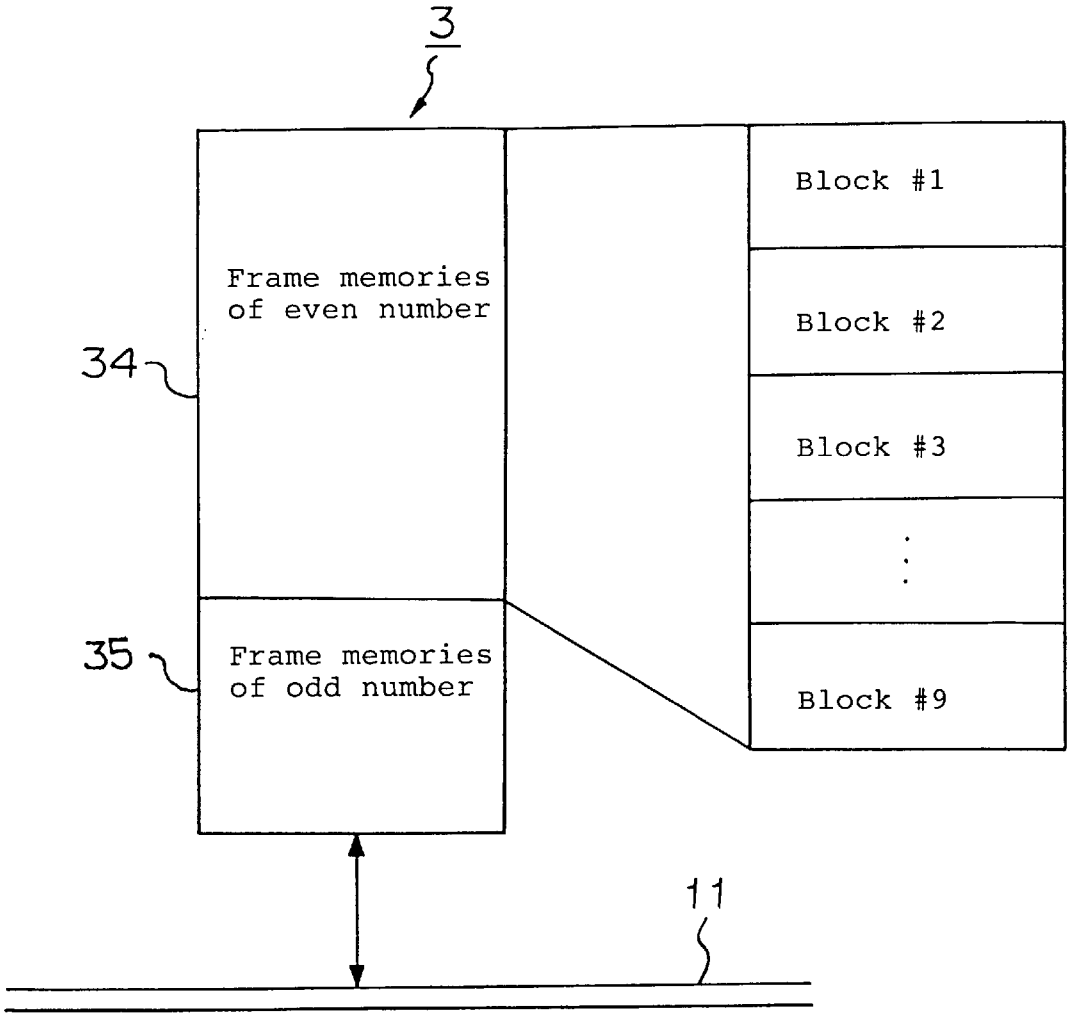
FIG. 11 is a diagram showing the spatial structure of a memory in DRAM in the second embodiment.

FIG. 11 is a diagram showing another embodiment of the memory space of DRAM3. The region of DRAM3 is divided into two regions. One of the regions is formed of frame memories of even number 34 for storing picture image data of frames of even number, and is divided into 9 blocks. The other is frame memories of add number 35 for storing picture image data of frames of odd number, and is divided into 5 blocks. When a VGA system is used, one block is constituted by 72×630×3 (RCB)=138,240 bits. Accordingly, a capacity required for DRAM3 in this case is (9+5)×138,240=1,935,360 bits. The general construction of the driving circuit is the same as the construction shown in FIG. 1.

Figure 12:
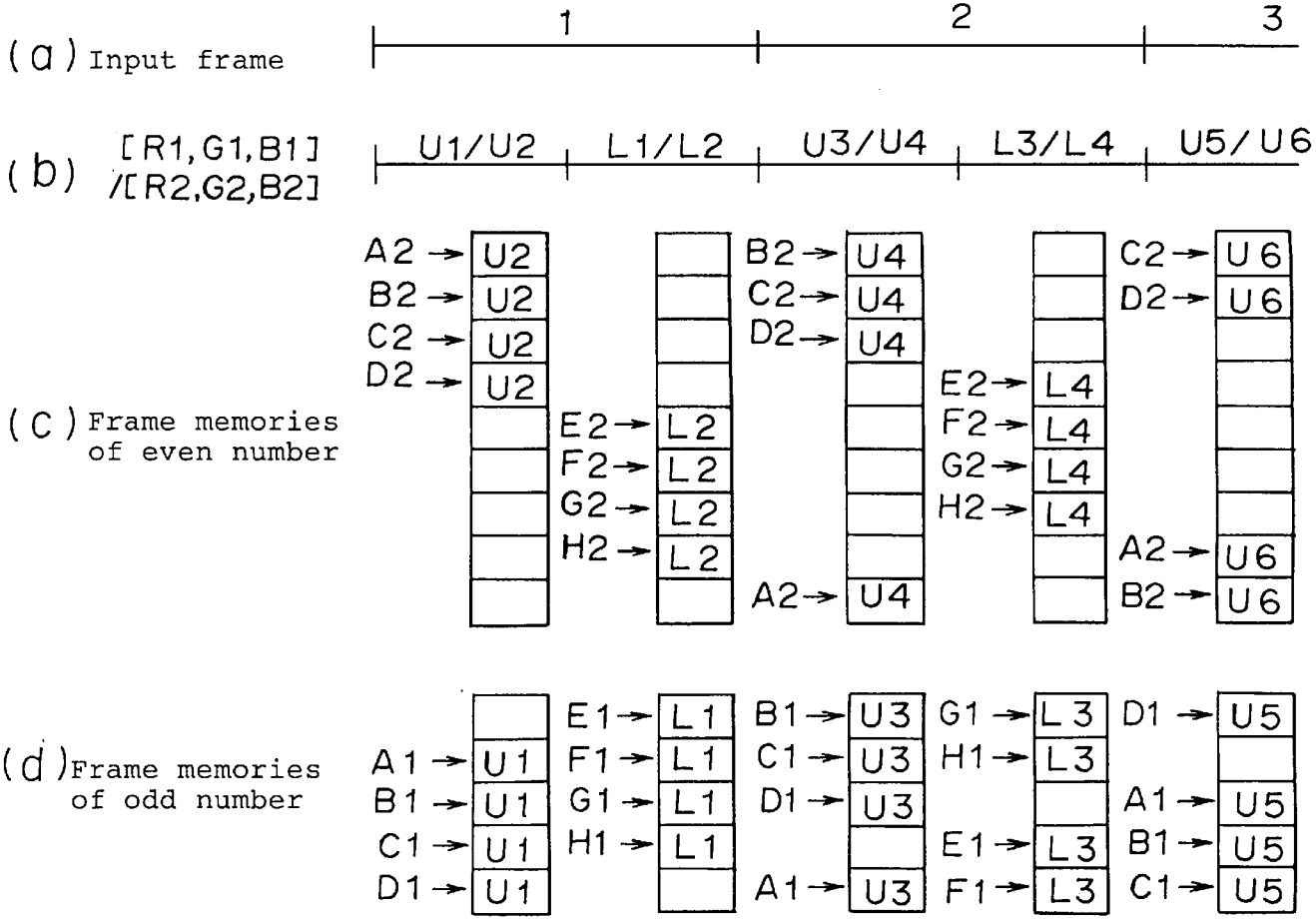
FIG. 12 is a diagram showing a method of writing data in DRAM in the second embodiment.

Operations of the driving circuit will be described. FIG. 12 is a diagram showing how data are written in DRAM3. In FIG. 12, for instance, A1 designates data to be displayed in an area A in the upper portion of the liquid crystal display panel in the first display frame. U1 designates the first display frame displayed in the upper portion of the liquid crystal display panel. L1 designates the first display frame to be displayed in the lower portion of the liquid crystal display panel. As shown in FIG. 12, the frame memories of even number 34 store picture image data of the frames of even number in each of the display frames, and the frame memories of odd number 35 store picture image data of the frames of odd number in each of the display frames. The definition of the region A to the region H is the same as in FIG. 8.

Picture image data from a personal computer or the like are inputted to the frame modulation/dither circuit 1 successively in the order. The frame modulation/dither circuit 1 outputs data which constitute the first display frame and the second display frame. The data of the first display frame are inputted to the shift resistor 21 of the writing FIFO2, and the data of the second display frame are inputted to the shift resistor 24 of the writing FIFO2. When the data are set in the latch circuits 22, 23 of the writing FIFO2, the memory control section 4 is so adapted that data are successively outputted from the writing FIFO2 to the bus 11. The frame modulation/dither circuit 1 outputs data of two display frames in parallel in a term of one period of input frame as shown in FIG. 12*a*, FIG. 12*b*. In a former half term, picture image data to be displayed in the upper portion of the liquid crystal display panel in the first display frame and the second display frame are outputted.

As shown in FIGS. 12*c* and 12*d*, the memory control section 4 performs control of write-addressing so that for instance, data corresponding to the initial 24 lines of the first display frame (data corresponding to the region A of the first display frame=A1) are set in the block #2 of the frame memories of odd number 35 in DRAM3. Further, it performs control of write-addressing so that the data for the initial 24 lines of the second display frame (data corresponding to the A region of the second display frame=A2) are set in the block #1 of the frame memories of even number 34 in DRAM3.

Then, the memory control section 4 performs write-addressing so that data for the next 72 lines of the first display frame (data corresponding to the B region of the first display frame=B1) are set in the block #3 of the frame memories of odd number 35 of DRAM3. Further, it performs write-addressing so that data for the next 72 lines of the second display frame (data corresponding to the region B of the second display frame=B2) are set in the block #2 of the frame memories of even number 34 of DRAM3.

Then, the memory control section 4 performs control of write-addressing so that data for the next 72 lines of the first display frame (data corresponding to the C region of the first display frame=C1) are set in the block #4 of the frame memories of odd number 35 of DRAM3. Further, it performs control of write-addressing so that data for the next 72 lines of the second display frame (data corresponding to the C region of the second display frame=C2) are set in the block #3 of the frame memories of even number 34 of DRAM3.

Continuously, the memory control section 4 performs control of write-addressing so that data for the next 72 lines of the first display frame (data corresponding to the D region of the first display frame=D1) are set in the block #5 of the frame memories of odd number 35 of DRAM3. Furthers it performs write-addressing so that the data for the next 72 lines of the second display frame (data corresponding to the D region of the second display frame=D2) are set in the block #4 of the frame memories of even number 34 of DRAM3.

Thus, one display frame is stored in the predetermined regions of DRAM3.

While the above-mentioned operations for writing data in the memories are performed, operations for reading data from the memories are performed in parallel. Strictly speaking, the operations for reading data from the memories are executed in a term in which data from the writing FIFO2 are not written in DRAM3, i.e., in a term in which data from the frame modulation/dither circuit 1 are passed through shift resistors 21, 24 in the writing FIFO2.

Figure 13:
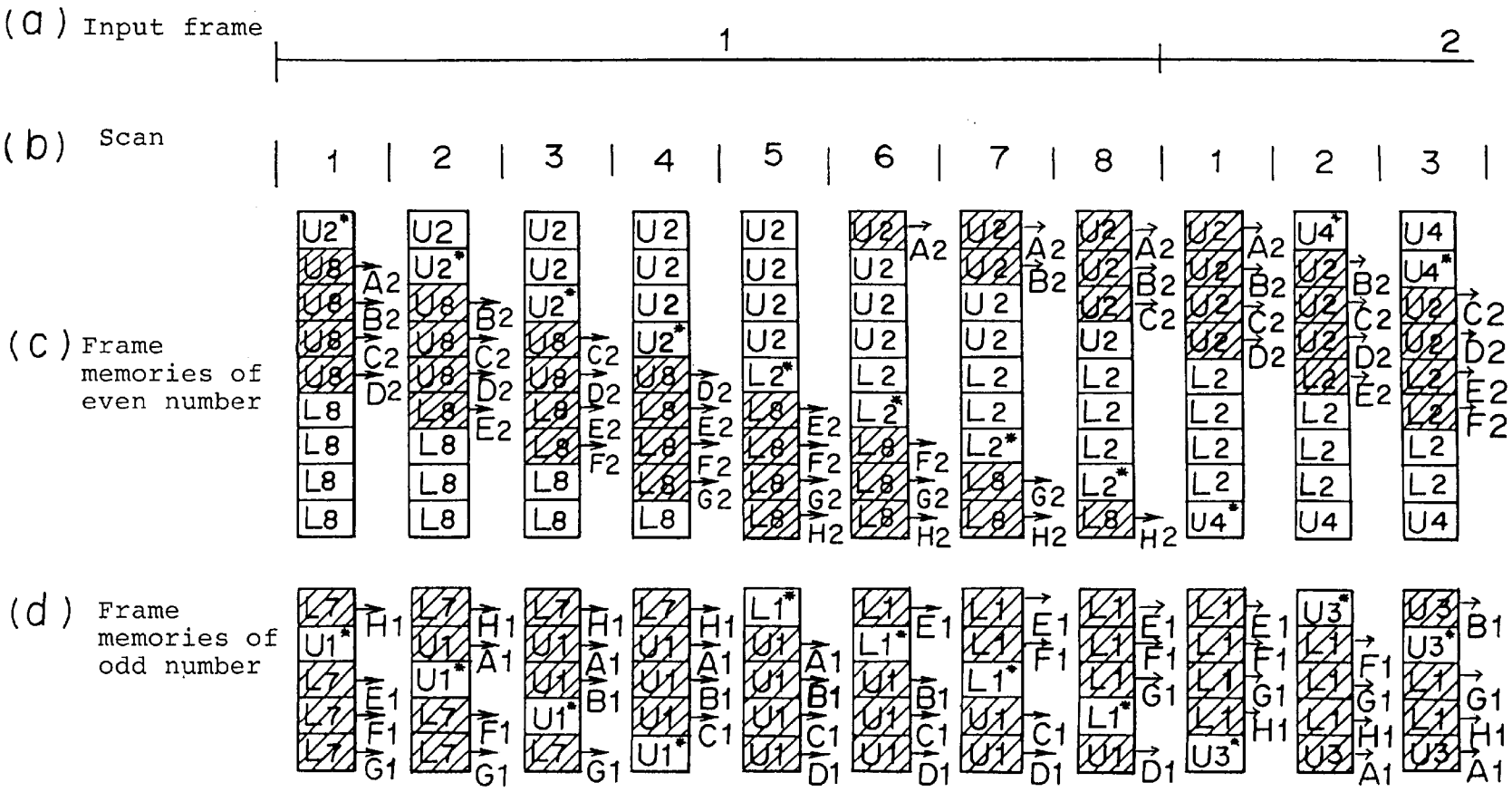
FIG. 13 is a diagram showing how data are written in each block of DRAM and how data are read from the blocks in the second embodiment.
Figure 15:
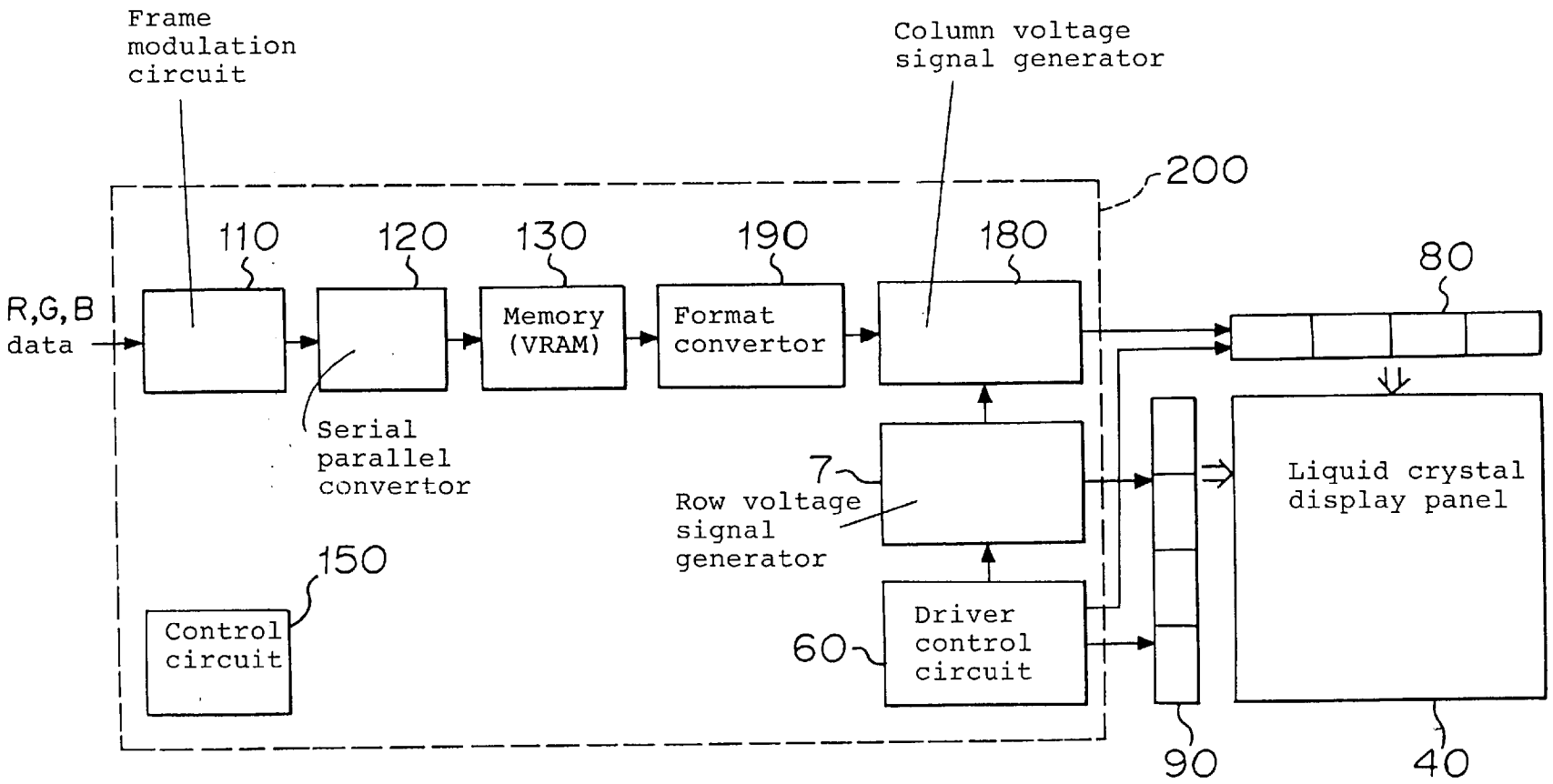
FIG. 15 is a block diagram showing an example of conventional driving circuit for a liquid crystal device.

FIG. 13 is a diagram showing how data are written in or how data are read from each block of DRAM3. In FIG. 3, data are read from blocks having hatched lines and data are written in blocks having a mark *. For instance, picture image data (A1, B1, C1, D1) of the upper portion of the first display frame are successively written in the frame memories of odd number 35 in the first to fourth scanning terms in the first input frame term. On the other hand, picture image data (A2, B2, C2, D2) of the upper portion of the second display frame are successively written in the frame memories of even number 34.

In these terms, the memory control section 4 performs control of reading data, which are already set, from the blocks which do not undergo writing operations. The read data are supplied to the reading FIFO5. As shown in FIGS. 12*c* and 12*d*, data are read, in one scanning term, from 8 blocks, i.e., 4 blocks in which data displayed in 4 regions of the upper portion of the liquid crystal panel are set and 4 blocks in which data displayed in 4 regions of the lower portion are set. Accordingly, 4 times of reading of data are executed from each of the blocks in which data displayed in each of the regions are set, in 4 scanning terms=one display frame term.

The reading FIFO5, the column voltage signal generator 6 and the row voltage signal generator 8 and so on operate in the same manner as in the first example. As described above, control of reading and writing can be obtained in 15 blocks of DRAM3.

In the above-mentioned examples, the case of driving the VGA panel has been explained. However, the driving circuit used can be applied to a case of driving another type of liquid crystal display panel. For instance, it is applicable to driving a SVGA panel of 800×600 pixels. For driving the SVGA panel, one block is constituted by 84×800×3 (RGB)=201,600 bits. Accordingly, a capacity required for DRAM3 is (9+5)×201,600=2,822,400 bits. In this case, the number of subgroups is 77 (including a subgroup for reading a dummy), and the number of times of reading by the reading FIFO5 in one subgroup term is 400.

In accordance with the driving circuit for a liquid crystal display device according to the present invention, picture image data corresponding to each region in the liquid crystal display element are written in each block, and the picture image data are successively read from the blocks to which writing operations are not conducted. Accordingly, data can be read at a substantially high frame frequency while DRAM is used as a memory.

In accordance with an aspect of the present invention, since the driving circuit for a liquid crystal display device stores picture image data to be displayed in an upper portion or a lower portion of the liquid crystal display element, in a region among regions in memories; stores the picture image data to be displayed in the upper portion of the liquid crystal display element in one among the other regions, and stores the picture image data displayed in the lower portion of the liquid crystal display element in the other among the other regions, data transfer between memories is unnecessary, and the driving circuit can be realized in a further simplified form.

In accordance with an aspect of the present invention, since the driving circuit of the liquid crystal display device comprises two memory regions wherein a region of the memories includes blocks the number of which is increased by one from the number of the regions at a side of the liquid crystal display element, and the other of the memories includes blocks the number of which is increased by one from the twice of the number of the regions at the side of the liquid crystal display element, data can be read from the memories at a substantially high frame frequency while DRAM is used as memories when dual scanning is conducted.

In accordance with an aspect of the present invention, since the driving circuit of the liquid crystal display device stores picture image data of frames of odd number in display frames in a region among regions of the memories, and stores picture image data of frames of even number in the display frames in the other region, data transfer between memories is unnecessary, and the driving circuit can be realized in a further simplified circuit structure. Further, a capacity of the memories can be reduced.

In accordance with an aspect of the present invention, since the driving circuit of the liquid crystal display device is provided with a timing control means for performing timing control by using the clock signals which are in synchronism with input picture image data, control of timing can be executed accurately in comparison with a conventional driving circuit. Further, since it does not include an analog circuit, a structure suitable for LSI can be formed.

In accordance with an aspect of the present invention, since the driving circuit of the liquid crystal display device further comprises an arithmetic circuit for producing a value for determining a row electrode driving term, each row electrode driving term can be determined uniformly, and any dispersion of the effective voltage value in each of the row electrode driving terms does not occur.

In accordance with an aspect of the present invention, since the driving circuit of the liquid crystal display device uses a reference time point of controlling timing when a predetermined time has passed after an input of vertical synchronizing signal, a stable reference point can be set. In accordance with an aspect of the present invention, since the driving circuit of the liquid crystal display device uses an input time point of a horizontal synchronizing signal which is the intermediate in the entire horizontal synchronizing signals in one frame, the input time point being used as a reference time point for timing control, a stable reference time point can be set, and memories can be utilized effectively.

Obviously, numerous modifications and variations of the present invention are possible in light of the above teachings. It is therefore to be understood that within the scope of the appended claims, the invention may be practiced otherwise than as specifically described herein.

What is claimed is:

1. A method of driving a display device having a plurality of scanning lines and a plurality of data lines comprising the steps of:

selecting simultaneously a first group of said plurality of scanning lines in said device;

dividing a single matrix picture area into a plurality of picture area blocks, each one of said plurality of picture area blocks including a second group of said plurality of scanning lines, wherein a number of said second group of said plurality of scanning lines is an integral multiple of a number of said first group of said plurality of scanning lines, wherein said single matrix picture area includes said plurality of scanning lines and said plurality of data lines;

dividing each one of at least one memory into a plurality of memory blocks, wherein each one of said plurality of memory blocks has sufficient capacity to store all reading and writing data displayed on each one of said plurality of picture area blocks, and said each one of said plurality of memory blocks is accessible in parallel;

writing display data in said each one of said at least one memory;

reading out said display data from said each one of said at least one memory; and performing at least one arithmetic operation on display data which has been read out by said step of reading out to produce a plurality of signals to be applied to said plurality of data lines, wherein a first plurality of frames for writing said display data are synchronized with a second plurality of frames for reading said display data, and each one of said plurality of memory blocks undergoes reading a predetermined number of times before new display data are written into said each one of said plurality of memory blocks.

2. The method according to claim 1, wherein said single matrix picture area is scanned by one continuous scanning operation;

a length of each one of said first plurality of frames is an integral multiple of a length of each one of said second plurality of frames; and a number of said plurality of memory blocks is at least one greater than a number which is a sufficient memory capacity for receiving data to be written in a memory within one of said second plurality of frames from said at least one memory.

3. The method according to claim 1, wherein an upper portion and a lower portion of said single matrix picture area are driven respectively by independent scanning;

a length of each one of said first plurality of frames is an integral multiple of a length of each one of said second plurality of frames; and a number of said plurality of memory blocks is at least two greater than a number which is a sufficient memory capacity for receiving data written in a memory within one of said second plurality of frames from said at least one memory.

4. The method according to claim 3, wherein said length of each one of said first plurality of frames is twice said length of each one of said second plurality of frames, and each one of said at least one memory includes three regions, and each one of said three regions includes a group of said plurality of memory blocks wherein a number of said group of said plurality of memory blocks is larger than a number of a group of said plurality of picture area blocks at a side of said device.

5. The method according to claim 4, wherein picture image data displayed in an upper portion and a lower portion of said device are stored in a first one of said three regions of one of said plurality of memories;

picture image data displayed in said upper portion of said device are stored in a second one of said three regions, wherein said first one of said three regions is different from said second one of said three regions, and picture image data displayed in said lower portion of said device are stored in a third one of said three regions, wherein said third one of said three regions is different from said second one of said three regions and from said first one of said three regions.

6. The method according to claim 3, wherein said length of each one of said first plurality of frames is twice said length of each one of said second plurality of frames;

each one of said plurality of memories has, a first region including a first group of said plurality of memory blocks, said first group of said plurality of memory blocks having a number of said plurality of memory blocks which is one greater than a number of said plurality of picture area blocks, and a second region including a second group of said plurality of memory blocks wherein a number of said second group of said plurality of memory blocks is one greater than twice a number of said plurality of picture area blocks of said device.

7. The method according to claim 6, wherein picture image data of an odd number of said first plurality of frames and said second plurality of frames are stored in a first plurality of display frames, in one of said first region and said second region, and picture image data of an even number of said first plurality of frames and said second plurality of frames are stored in a second plurality of display frames, in a different one of said first region and said second region.

8. The method according to claim 1, wherein a plurality of clock signals which are in synchronism with input picture image data inputted to said at least one memory are used for synchronizing the writing of data into said at least one memory with the reading of the data from said at least one memory and with a timing to an electrode driving means.

9. The method according to claim 8, wherein said plurality of clock signals in synchronism with the input picture image data are counted, and when a counted value for a row electrode driving time reaches a predetermined value, a judgment of row electrode driving time is provided.

10. The method according to claim 8, wherein a reference time point for a timing operation is determined when a predetermined time has passed after a vertical synchronizing signal has been inputted.

11. The method according to claim 10, wherein said reference time point is determined at an input time point of a horizontal synchronizing signal which is intermediate in all horizontal synchronizing signals in one frame of said first plurality of frames and said second plurality of frames, after the vertical synchronizing signal has been inputted.

12. A driving circuit for a display device, aid display device having a plurality of scanning lines and a plurality of data lines comprising:

at least one memory for temporarily storing input picture image data, each one of said at least one memory including a plurality of memory blocks, each one of said plurality of memory blocks having sufficient capacity to store all reading and writing data to be displayed on each one of a plurality of picture area blocks, said plurality of picture area blocks formed by dividing a single matrix picture area, each one of said plurality of picture area blocks including a group of said plurality of scanning lines wherein a number of said group of said plurality of scanning lines is an integral multiple of a number of simultaneously selected ones of said plurality of scanning lines, wherein said single matrix picture area includes said plurality of scanning lines and said plurality of data lines, a timing control means for synchronizing a first plurality of frames for writing data in said at least one memory with a second plurality of frames for reading the data from said at least one memory, and a memory control means for controlling writing new display data in each one of said plurality of memory blocks in parallel after each one of said plurality of memory blocks undergoes reading a predetermined number of times necessary for arithmetic operation for producing a plurality of data signals.

13. The driving circuit according to claim 12, wherein aid driving circuit is adapted to scan said single matrix picture area by one continuous scanning operation;

said timing control means controls so that a length of each one of said first plurality of frames is an integral multiple of each one of said second plurality of frames; and a number of said plurality of memory blocks is at least one greater than a number which is a sufficient memory capacity for receiving data to be written in a memory within one of said second plurality of frames from said at least one memory.

14. The driving circuit according to claim 12, wherein said driving circuit is so adapted that an upper portion and a lower portion of said single matrix picture area are scanned respectively by independent scanning operations;

said timing control means controls so that a length of each one of said first plurality of frames is an integral multiple of a length of each one of said second plurality of frames; and a number of said plurality of memory blocks is at least two greater than a number which is a sufficient memory capacity for receiving data to be written in a memory within one of said second plurality of frames from said at least one memory.

15. The driving circuit according to claim 14, wherein said timing control means is so adapted that said length of each one of said first plurality of frames is twice said length of each one of said second plurality of frames;

each one of said at least one memory includes three regions, and each one of said three regions includes a group of said plurality of memory blocks wherein a number of said group of said plurality of memory blocks is larger than a number of said plurality picture area blocks of said device, and a memory control means controls so that picture image data displayed in an upper portion and a lower portion of said device are stored in a first one of said three regions of one of said plurality of memories;

picture image data displayed in said upper portion of said device are stored in a second one of said three regions, wherein said first one of said three regions is different from said second one of said three regions, and picture image data displayed in said lower portion of said device are stored in a third one of said three regions wherein said third one of said three regions is different from said second one of said three regions and from said first one of said three regions.

16. The driving circuit according to claim 14, wherein said timing control means is so adapted that said length of each one of said first plurality of frames is twice said length of each one of said second plurality of frames;

each one of said plurality of memories has, a first region including a first group of said plurality of memory blocks, said first group of said plurality of memory blocks having a number of said plurality of memory blocks which is one greater than a number of said plurality of picture area blocks, and a second region including a second group of said plurality of memory blocks wherein a number of said second group of said plurality of memory blocks is one greater than twice a number of said plurality of picture area blocks of said device; and a memory control means stores picture image data of an odd number of said first plurality of frames and said second plurality of frames in a first plurality of display frames, in one of said first region and said second region, and said memory control means stores picture image data of an even number of frames in a second plurality of display frames, in a different one of said first region and said second region.

17. The driving circuit according to claim 12, wherein said timing control means is so adapted that a plurality of clock signals which are in synchronism with input picture image data inputted to said at least one memory are used for synchronizing the writing of data into said at least one memory with the reading of the data from said at least one memory and with a timing to an electrode driving means.

18. The driving circuit according to claim 17, wherein the timing control means includes an arithmetic circuit for providing a value for determining a row electrode driving time, and is so adapted that said plurality of clock signals in synchronism with the input picture image data are counted, and when a counted value reaches a predetermined value for a row electrode driving time, a judgment of row electrode driving time is provided.

19. The driving circuit according to claim 17, wherein a reference time point for a timing operation is determined when a predetermined time has passed after a vertical synchronizing signal has been inputted.

20. The driving circuit according to claim 19, wherein the timing control means is so adapted that said reference time point is determined at an input time point of a horizontal synchronizing signal which is intermediate in all horizontal synchronizing signals in one frame of said first plurality of frames and said second plurality of frames, after the vertical synchronizing signal has been inputted.

* * * * *